US005126792A

United States Patent [19]

Iwata

[11] Patent Number: 5,126,792

[45] Date of Patent: Jun. 30, 1992

[54] IMAGE FORMING APPARATUS HAVING ERASING MEANS FOR ERASING AN ELECTRICAL CHARGE IN A NON-IMAGE REGION OF AN IMAGE BEARING MEMBER

[75] Inventor: Yasuhiro Iwata, Yokohama, Japan

[73] Assignee: Kabushiki Kaisha Toshiba, Kawasaki, Japan

[21] Appl. No.: 671,960

[22] Filed: Mar. 19, 1991

[30] Foreign Application Priority Data

Mar. 30, 1990 [JP] Japan ..... 2-84616

[51] Int. Cl.[5] ..... G03G 21/00

[52] U.S. Cl. ..... 355/218; 355/204

[58] Field of Search ..... 355/204, 218, 210, 203, 355/208, 209, 243, 230, 231

[56] References Cited

U.S. PATENT DOCUMENTS

| | | | |
|---|---|---|---|
| 4,713,550 | 12/1987 | Anzai et al. | 355/204 X |
| 4,745,438 | 5/1988 | Acquaviva et al. | 355/218 X |
| 4,847,657 | 7/1989 | Hanada et al. | 355/218 |
| 4,870,457 | 9/1989 | Migita et al. | 355/208 |
| 4,910,553 | 3/1990 | Suzuki | 355/203 |
| 4,954,846 | 9/1990 | Matsuo et al. | 355/204 X |
| 4,990,956 | 2/1991 | Iwata | 355/218 |
| 5,006,904 | 4/1991 | Matsuo et al. | 355/204 X |

FOREIGN PATENT DOCUMENTS

| | | |
|---|---|---|
| 1-257875 | 10/1989 | Japan . |
| 1-270069 | 10/1989 | Japan . |
| 1-270077 | 10/1989 | Japan . |
| 1-270078 | 10/1989 | Japan . |

*Primary Examiner*—A. T. Grimley
*Assistant Examiner*—Sandra L. Brasé
*Attorney, Agent, or Firm*—Foley & Lardner

[57] ABSTRACT

The image forming apparatus according to this invention is adapted to erase unnecessary black images otherwise appearing on the peripheral portion of a copy sheet so that output images of a high quality are obtained. Further, erasable peripheral areas of the copy sheet on which unnecessary black images are otherwise formed are freely selected.

17 Claims, 18 Drawing Sheets

IMAGE FORMING APPARATUS HAVING ERASING MEANS FOR ERASING AN ELECTRICAL CHARGE IN A NON-IMAGE REGION OF AN IMAGE BEARING MEMBER

BACKGROUND OF THE INVENTION

1. Field of the Invention

A general electrostatic image forming apparatus comprises a document reading unit for illuminating a document image and transmitting light beams reflected therefrom to a photoconductor, an image forming unit including the photoconductor on which electrostatic latent images are formed in response to light beams from the image forming unit and the document images are reproduced, and a sheet delivering unit for feeding a copy sheet (a copy medium) to the image forming unit and ejecting the copied sheet on which the document image has been formed.

The document reading unit includes a document table on which an original document, or an original document medium to be read out is loaded, an illuminator for illuminating the original document, and an optical section for transferring light beams reflected from the original document.

The image forming unit comprises the photoconductor which is rotatably provided and on which electrostatic latent images are formed in succession in response to the light beams transferred from the document reading unit, a charger for loading electric charges on the photoconductor, a developing section for developing the latent images formed on the photoconductor, a transferring section for transferring the developed image on a transcript sheet (a transcript medium), a fixing device for fixing the images transferred to the transcript sheet, and a cleaner for cleaning the photoconductor so as to return the same to the initial state.

The sheet delivering unit has a sheet cassette for receiving the sheets to be transferred (the transcript sheets), a sheet feeder for supplying the transcript sheets to the image forming unit, and an output section for ejecting the sheets on which the image has been formed.

In the electrostatic image forming apparatus, a predetermined electric charges is given to the photoconductor, having photo-conductivity by means of the charger. The light beams reflected from the original document form images on the surface of the photoconductor through a plurality of reflecting mirrors and focusing lenses. Electrostatic latent images are formed on the surface of the photoconductor by the light beams and are developed by an developing agent such as toner supplied through the developing section, whereby the document images are reproduced. The developed images are transferred to the transcript sheet such as a paper sheet supplied from the sheet feeder and fixed by the fixing device. Thereafter, the sheet on which the images have been fixed is ejected. When toner which is thermally fusible is used as a developing agent, fixing is carried out by heating and pressing at the same time.

In an image forming apparatus such as an electronic copying machine employing a photoelectrographic process, an original document loaded on a document table is covered with a document cover. The portion of light beams is emitted from an illumination lamp on the outside areas of the original document, whereby the unnecessary electric charges otherwise left on the surface of a light sensitive drum is removed.

When the original document is read or scanned upon opening the document cover, for example, the light beams emitted from the illumination lamp on the portion outside of the original document do not form images on the photoconductive drum. The unnecessary electric charges at the outside portion of the original document are not removed, and the toner attaches to the portion of the copy sheet outside of the original document after development. When the original document size is smaller than the size of the copy sheet (the sheet to be transferred) or when the copy size is reduced even if the original document size is equal to the size of the copy sheet, the outside portion of the output image (copied image) is blackened by the toner. Further, when a very thick original document such as a book is to be copied, the document cover does not fully contact the document table, and an unnecessary black stripe or stripes are formed on the portion of the copy sheet which is outside of the output image, the portion being hereinafter referred as the outside-of-document portion.

The copy on which the unnecessary black stripe or stripes appear is not attractive and is considered poor in quality. In addition, much toner is wasted. The black stripe or stripes are liable to make the toner adhere to fixing rollers, so that the copy sheet is apt to wind around one of the fixing rollers, to cause a jammed copy sheet.

In the conventional copying machine, the erasable region or regions corresponding to the unnecessary black stripe or stripes are automatically determined by the size of the copy sheet and the image size of the original document to be copied. Thus, the erasable region or regions cannot freely be set.

When a copy holding means is opened during the copying operation, in a case where the document size or the copy size is smaller than the size of the copy sheet, the black stripe or stripes are formed o the outside-of-document portion of the copy sheet. The resultant output images are not only poor in quality, developing agent is wasted.

SUMMARY OF THE INVENTION

The object of this invention is to provide an image forming apparatus which erases unnecessary black images appearing on the outside-of-document portion of a copy sheet even if the image size is smaller than the size of the copy sheet, so as to improve the quality of the output images and freely set the erasable region or regions of black images.

In order to attain this object, an image forming apparatus according to this invention comprises a document table on which an original document is loaded, document holding means for sandwiching the original document in cooperation with the document table, detecting means for detecting the release of holding the original document by means of the document holding means, image carrying means on which a transferred images corresponding to document images optically transmitted by an optical system, image erasing means for preventing outside-of-document portions of the transferred images on a copy sheet from being formed on the image carrying means when the detecting means detects the release of holding the original document by means of the document holding means during image formation, and setting means for setting an area of the transferred images to be erased by means of the erasing means.

When it is detected that the document holding means is opened in this invention, the images appearing on the outside-of-document portion on the copy sheet are erased by removing unnecessary electric charges on that portion of the photoconductor which corresponds to the outside-of-document portion. Further, the image erasable region around the document images is freely selected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

This invention will now be explained by way of preferred embodiments with reference to the accompanying drawings.

Figure 1:
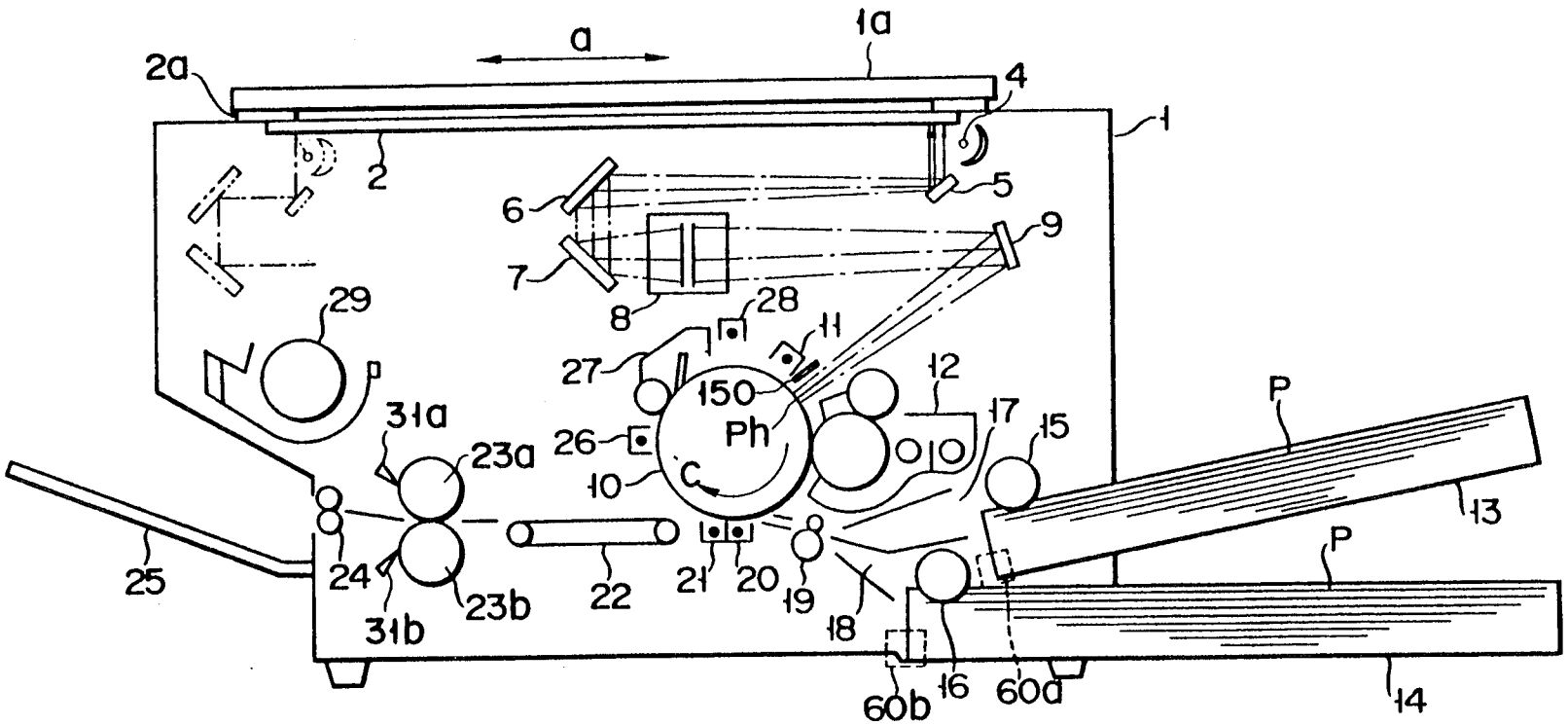
FIG. 1 is a lateral elevational view of a first embodiment of a copying machine according to this embodiment.
Figure 2:
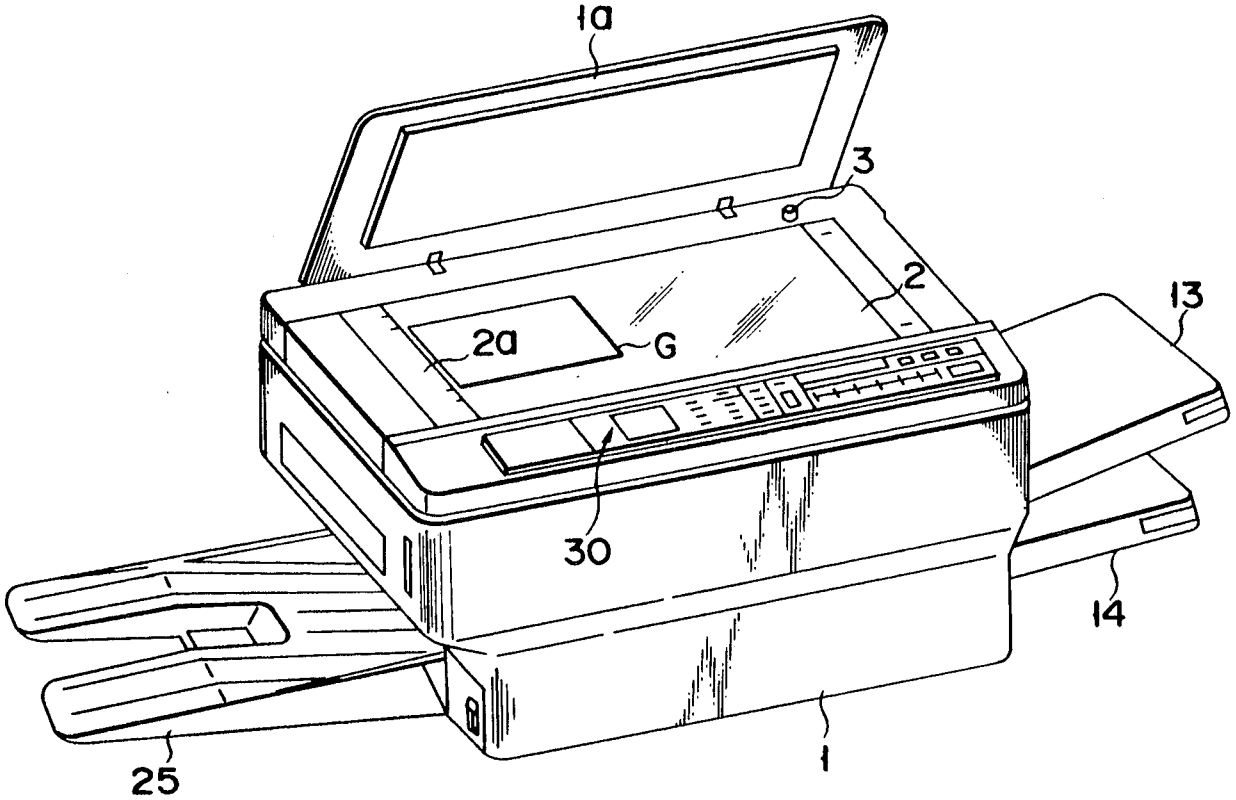
FIG. 2 is a perspective view showing the exterior appearance of the copying machine of FIG. 1.

FIGS. 1 and 2 show a schematic view of an image forming apparatus according to this invention, such as a copying machine. A document table 2 made of transparent glass is fixed to the upper surface of the main body 1 of the copying machine. In the vicinity of the document table 2 is provided a cover detecting switch 3 for detecting the opening and closing of a document cover 1*a*. On the document table 2 are provided fixed scales 2*a* which form the reference lines for setting an original document or an original document sheet (hereinafter referred to as the "original document") G.

The original document G on the document table 2 is illuminated and read by an optical system comprising an illumination lamp 4 and mirrors 5, 6 and 7 provided in the main body 1. In this process, the mirrors 6 and 7 are moved in direction a at half the speed of the mirror 5 in order that the predetermined optical length of the optical system is maintained. The light beams reflected from the original document G during the reading operation by the optical system or the light beams reflected from the original document G due to light radiation from the illumination lamp 4 are reflected by the mirrors 5, 6 and 7, and thereafter pass through a magnification varying lens block 8. Further, the light beams are reflected by the mirror 9 and are lead to a photoconductive drum 10 so that the images of the original document G are formed on the surface of the photoconductive drum 10.

As rotated in the direction shown by an arrow c in FIG. 1, the surface of the photoconductive drum 10 is electrically charged by means of a charger 11. After this, the document images are transferred thorough a slit exposed portion Ph on the surface of the drum 10, so that electrostatic latent images are formed thereon. The latent image areas are adhered with toner by means of a developing section 12, so as to be visualized or visible.

Copy sheets P (media to be copied) are picked up one by one by means of a feed roller 15 or 16 from selected one of an upper sheet feeding cassette 13 and a lower sheet feeding cassette 14. The picked-up copy sheet P is guided to a pair of resist rollers 19 via a sheet guide 17 or 18 and is fed to a transferring unit by means of the resist rollers 19.

The sheet feeding cassettes 13 and 14 are detachably provided at the right lower portion of the main body 1. Either one of the sheet feeding cassettes 13 and 14 is selected on a panel as will be described later. The sizes of the cassettes 13 and 14 are detected, respectively, by cassette size detecting switches 60*a* and 60*b*, each comprising a plurality of microswitches which are turned on or off according to the size of the respective cassette provided in the main body 1, whereby the sizes of copy sheets in the cassette 13 and 14 are detected.

The copy sheet P fed to the transferring unit is closely contacted with that portion of the surface of the photoconductive drum 10 which faces a transfer charger 20. Toner images on the photoconductive drum 10 are transferred onto the copy sheet P by means of the charger 20. The image-transferred copy sheet P is electrically separated from the photoconductive drum 10 by means of a sheet separating charger 21. The sheet P is transported by means of a transportation belt 22 to a pair of fixing rollers 23*a* and 23*b* provided at the end of the belt 22. The fixing rollers 23*a* and 23*b* are respectively provided with sheet separating pawls 31*a* and 31*b* for preventing the sheet P from being wound around either one of the rollers 23*a* and 23*b*. When the sheet P passes between the rollers 23*a* and 23*b*, the transferred images on the sheet P is fixed. The sheet P the images on which are fixed is ejected by means of a pair of ejecting rollers 24 to a tray 25 which is disposed outside of the main body 1.

After the transfer of the sheet P, the electric charges on the photoconductive roller 10 are removed by means of a charge eraser 26. Thereafter, the surface of the photoconductive drum 10 is cleaned by means of a cleaner 27 so to remove the residual toner thereon and the remaining images thereon are erased. As a result, the photoconductive drum 10 is returned to the initial state. A cooling fan 29 is provided for preventing the a temperature rise in the main body 1.

Figure 3:
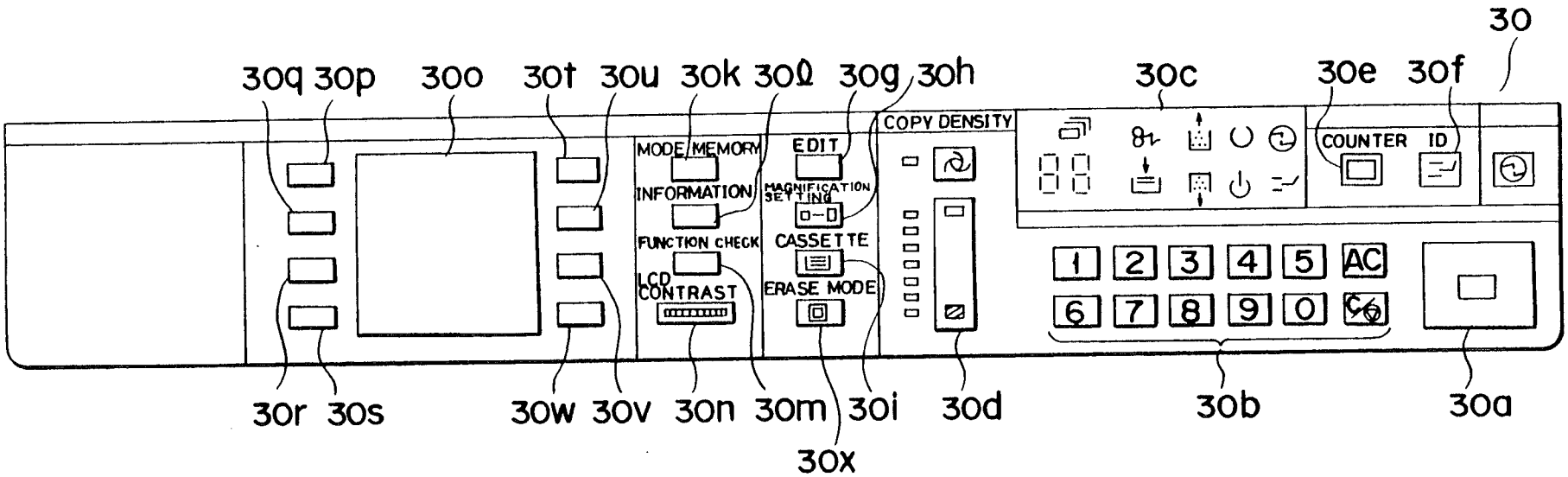
FIG. 3 is a plan view of the arrangement of the elements of the control panel of the copying machine of FIG. 1.
Figure 4:
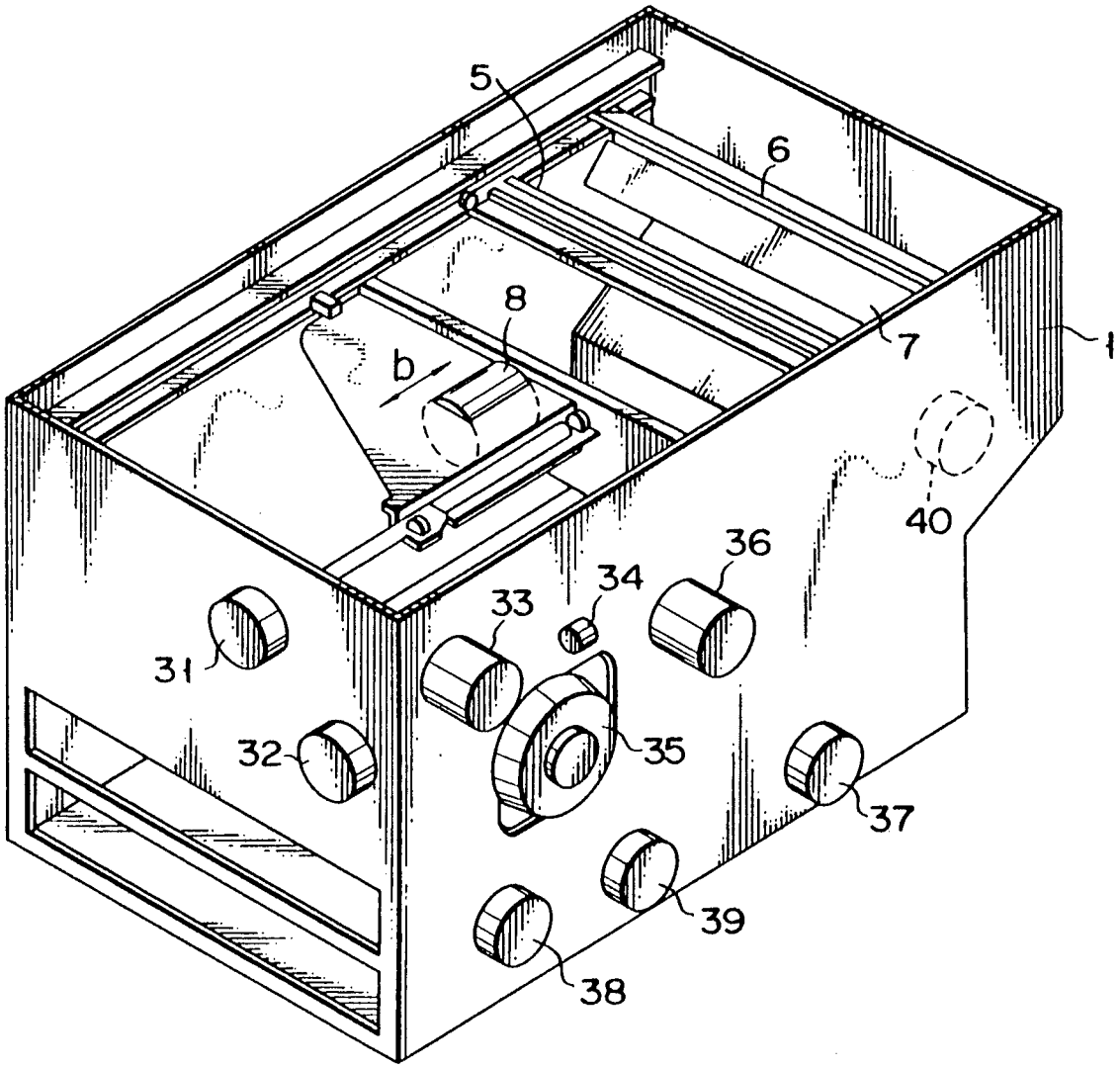
FIG. 4 is a perspective view of the driving unit of the first embodiment.

As shown in FIGS. 3 and 4, the main body 1 has a control panel 30 on which are arranged a copy key 30*a* for instructing the start of copying, ten keys 30*b* for selecting the number of sheets to be copied and the like, an indicating section 30*c* for indicating the operational conditions of the related parts, and a copy sheet and the like, a density input key 30*d* for selecting copy image density, a total copy number reading key 30*e* for selecting the total number of copy sheets, and an ID counting key 30*f* for selecting the number of copy sheets corresponding to each ID code in case where ID copying modes are set to copy the original document only when an ID code coincides with the code set by the ID counting key 30*f*. Here, the ID code is a code for permitting the required document or documents to be copied for a specific user, and is input by means of an external counter or an ID card.

The control panel 30 further has an edit key 30*g* for carrying out multi-copying, a copy magnification input key 30*h* for selecting copy magnification, a cassette selecting key 30*i* for selecting either one of the upper and lower sheet feeding cassettes 13 and 14, a mode memory key 30*k* for memorizing a copying condition which is set by the operation of the edit key 30*g*, for example, and for reading out a copying condition which has previously been memorized, and an information key 30*l* which is operated when information corresponding to any mode is wanted. When, for example, a copy sheet is jammed, information for removing the jammed sheet is indicated on an indictor 30*o* as will later be described, upon the operation of the information key 30*l*.

The control panel 30 is still further provided with function checking key 30*m*, a dial 30*n* for adjusting the contrast of the indicator 30*o*, the indicator 30*o* formed by a liquid Crystal dot matrix panel, for example, and indicating the set conditions of the copying machine in the form of letters and the like, control keys 30*p*, 30*q*, 30*r*, 30*s*, 30*t*, 30*u*, 30*v* and 30*w* provided on both sides of the indicator 30*o* for selecting functions indicated on the indicator 30*o*. when the function checking key 30*m* is operated, the function set is indicated on the indicator 30*o*. The indicator 30*o* is used such that, when any one of the keys 30*e*, 30*f*, 30*g*, 30*h*, 30*i*, 30*k*, 30*l* and 30*m* is operated, it indicates the condition of the copying machine corresponding to the operated key in the form of corresponding letters or the like.

The control panel 30 further has an erase key 30*x* for preventing unnecessary black images (a black stripe or stripes) from being formed on the peripheral portion of a copy sheet when the copy sheet has the size larger than the copy size. The erase key 30*x* is used to turn off an erase mode for erasing the black images otherwise formed on the peripheral portions of the paper sheet and for setting an erase area.

In FIG. 4 are shown driving mechanisms comprising motors for moving the driven parts of the copying machine. A lens motor 31 moves the lens block 8 in the directions indicated an arrow b so as to vary the magnification of the lens system. A mirror motor 32 adjusts the distance (the optical length) between the mirror 5 and the mirrors 6 and 7 so as to vary the magnification of the lens system. A scanning motor or a document reading motor 33 is used to move the illumination lamp 4, mirrors 5, 6 and 7 so as to read the original document. A shutter motor 34 is adapted to move a shutter (not shown) for adjusting a charged width of the electrically charged portions of the photoconductive drum 10 which are charged by means of the charger 11 when the magnification is changed. A developing motor 35 drives developing rollers and the related parts thereto of the developing section 12. A drum motor 36 drives the photoconductive drum 10. A fixing motor 37 operates the transportation belt 22 acting as a transportation path, the fixing rollers 23 and the ejecting rollers 23 and 24. A feeding motor 38 rotates the sheet feeding rollers 15 and 16. A delivering motor 39 revolves the resist rollers 19. A fan motor 40 is used for driving the cooling fan 29.

Figure 5:
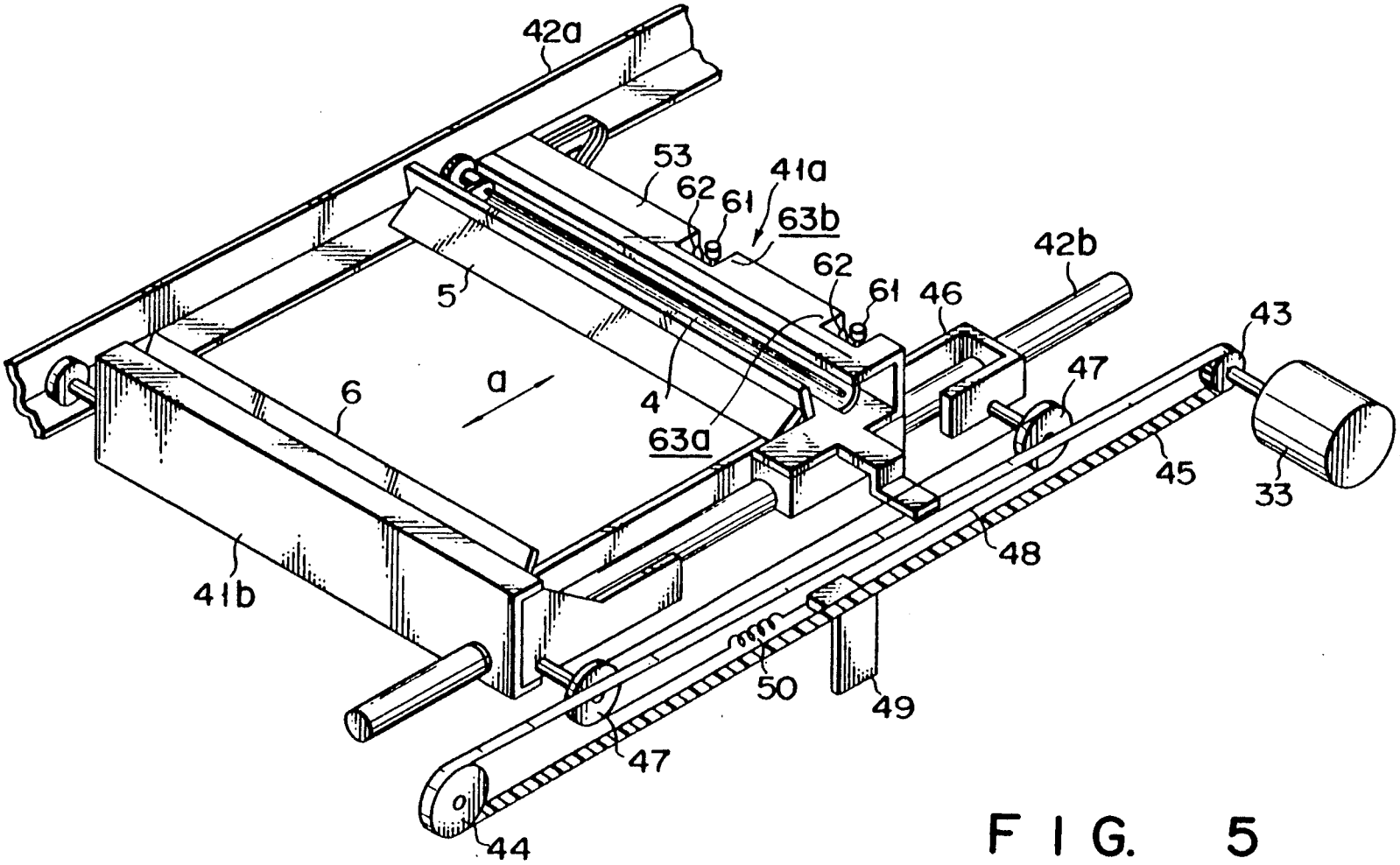
FIG. 5 is a schematic perspective view of the driving mechanism of the optical system of the first embodiment.

In FIG. 5 is shown a reciprocating mechanism for reciprocating the optical system. The mirror 5 and the illumination lamp 4 are supported on a first carriage 41*a*, and the mirrors 6 and 7, on a second carriage 41*b*. The carriages 41*a* and 41*b* are so guided as to be movable in parallel to each other in the directions as indicated by an arrow a. The motor 33 is a four-phase pulse motor type, adapted to drive a pulley 43. An endless belt 45 is wound on the pulley 43 and another pulley 44, stretched therebetween. One end of the first carriage 41*a* which supports the mirror 5 is fixed to an intermediate portion of the belt 45.

On the guide portion 46 of the second carriage 41*b* are rotatably provided two pulleys 47 separated axially of a rail 42*b*. A wire 48 is wound around the pulleys 47 so as to be stretched therebetween. One end of the wire 48 is fixed to a connecting element 49, and the other end thereof, to the connecting element 49 via a coil spring 50. On end of the first carriage 41*a* is fixed to an intermediate portion of the wire 48. The pulse motor 33 rotates the belt 45 so as to move the first carriage 41*a*. The movement of the first carriage 41*a* drives the second carriage 41*b*. As the pulleys 47 move, the second carriage 41*b* moves in the same running direction of the first carriage 41*a* at half speed of the carriage 41*a*. The running direction of the first and the second carriages 41*a* and 41*b* are controlled by changing the rotational directions of the pulse motor 33.

Figure 6:
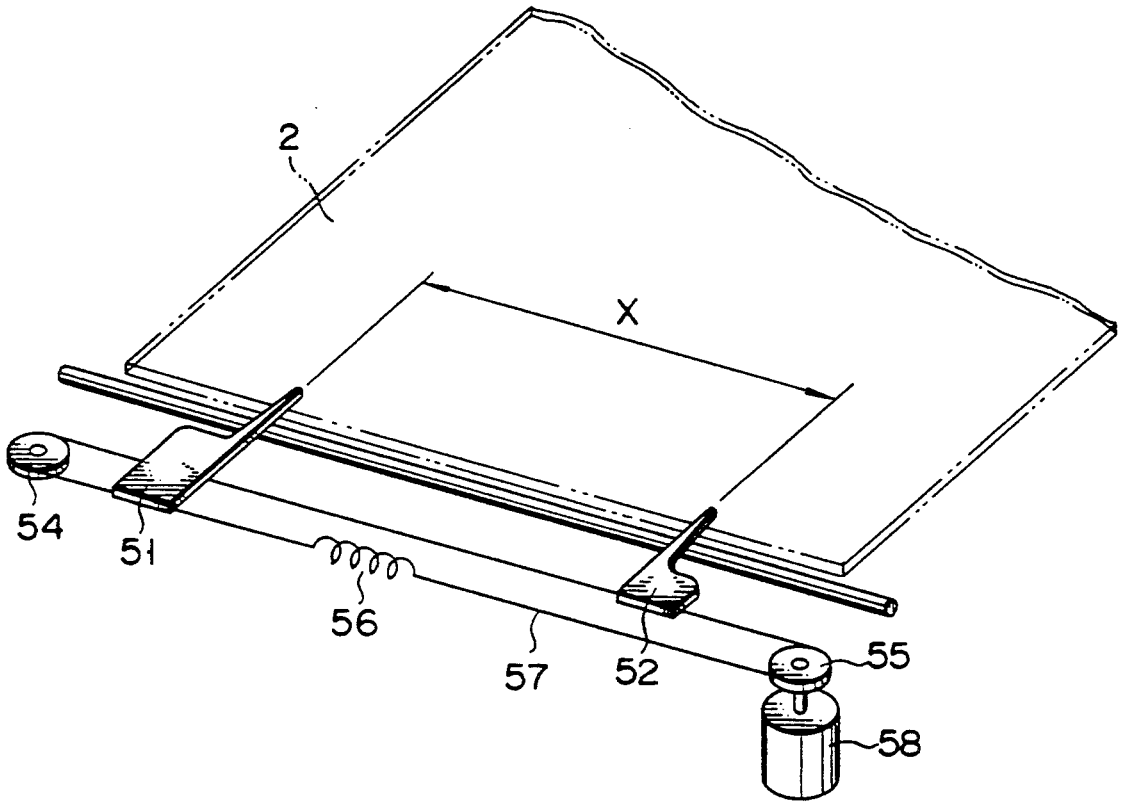
FIG. 6 is a schematic perspective view of the driving mechanism of the first embodiment.

A copy area is indicated on the document table 2 (FIG. 6). Let it be assumed that the sheet size designated by the cassette selecting key 30*i* is (Px, Py) and a copy magnification designated by the magnification setting key 30*h* is K. Then, the copy area (x, y) is defined by the equations $x=Px/K$ and $y=Py/K$. The x is the distance between pointers 51 and 52 provided on the rear side of the document table 2, and the y is the distance between a scale 53 and a fixed scale 2*a* provided on the upper surface portion of the document table 2.

As shown in FIG. 6, the pointers 51 and 52 are fixed to a wire 57 stretched between pulleys 54 and 55 via a spring 56. The pulley 55 is rotated by means of a motor 58. Accordingly, the motor 58 is driven in accordance with the copy range defined by the x so that the distance between the pointers 51 and 52 is changed.

The first carriage 41*a* is moved to a predetermined position (a home position corresponding to each set magnification) by moving the motor 33 in accordance with the sheet size and the copy magnification. The operation of the copy key 30*a* moves the first carriage 41*a* to the reading start position of the second carriage 41*b*. Thereafter, the illumination lamp 4 is turned on and moved in the direction in which it separates from the second carriage 41*b*. After the original document G has been read, the illumination lamp 4 is turned off and is returned to the home position.

Figure 7:
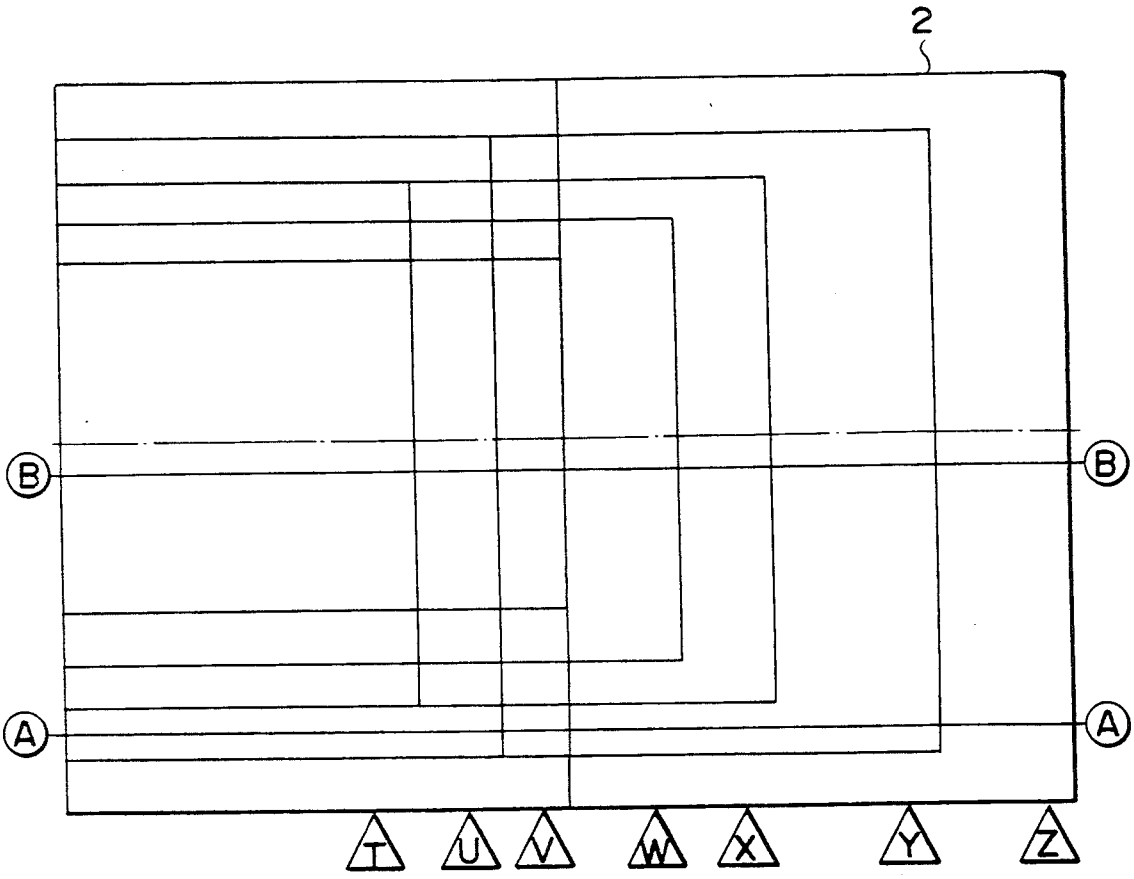
FIG. 7 illustrates how to detect the size of an original document in the first embodiment.

The size of the original document G defined by the first carriage 41*a* is previously detected upon reading the original document G. As shown in FIG. 5, the first carriage 41*a* is provided with document detectors 63*a* and 63*b* each comprising a photo-receptors 61 such as imageline sensors and photoemitters 62 such as photodiodes. As shown in FIG. 7, the document detectors 63*a* and 63*b* are arranged so as to move in the directions along lines A—A and B—B with respect to the document table 2 in accordance with the movement of the first carriage 41*a*. Upon the operation of the copy key 30*a*, the first carriage 41*a* is moved from the home position to the reading start position of the second carriage 41*b*. As the second carriage 41*b* is operated in such a direction as is moved to be separated from the first carriage 41*a*, the scanning or the document reading is carried out for detecting the size of the original document G. After the detection of the size of the original document, the detectors 63*a* and 63*b* are stopped, the first carriage 41*a* placed at the reading start position. Then, the illumination lamp 4 is turned on to move in the direction in which it separates from the second carriage 41*b*. After the scanning for forming the images of the original document G has been finished, the illumination lamp 4 is turned off and the first carriage 41*a* is returned to the home position.

Figure 8:
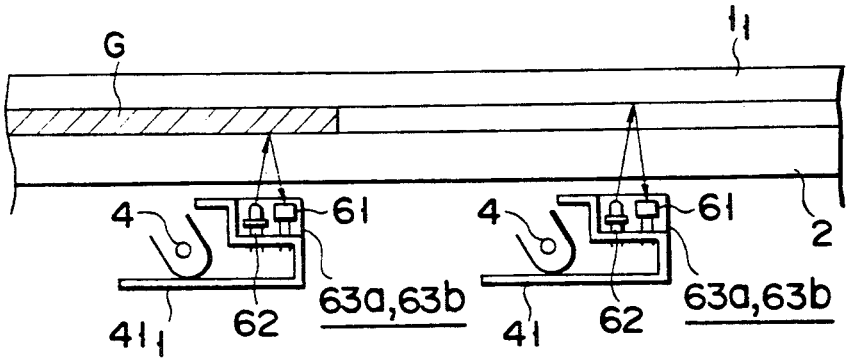
FIG. 8 is a cross-sectional view of the document detector of the first embodiment.

As shown in FIG. 8, the light beams reflected from the original document G and the document cover 1*a* illuminated with the light beams from the photoemitter 62 are received by photo-receptors 61 through the document table 2. The light beams from the photoemitter 62 are converted by the photoreceptors 61 to electrical signals which are supplied to a system controller via main processors as will later be described. The size of the original document G is automatically detected by means of the system controller in accordance with the level variation in response to the displacement of the first carriage 41*a*.

The existence or non existence of the original document on the document table 2 is checked by the strength of the spectrum of the reflected light beams, and the size of the original document G is determined during the reading operation of the original document G. In this process, when the document cover 1*a* does not closely contact the document table 2, the reflected light level is greatly reduced from the one when the document cover 1*a* and the document table 2 closely contact each other. When the document cover 1*a* is open, or when the document cover 1*a* cannot be fully closed as in a case where a thick original document such as a book is loaded on the document table 2, the existence or non existence of the original document G can be easily detected. In this connection, the size of the original document can easily be decided by scanning the lines A—A and B—B on the document table 2 thereby checking whether or not the original document G exists at the detecting position T, U, V, W, X, Y or Z.

The original document G of any size, for example, from the A5 size, to the A3 size can be placed on the document table 2 and any original document is adapted to be put on the document table 2 so that its central line coincides with the central line (shown by a one-dot Chain line) of the document table 2.

Figure 9:
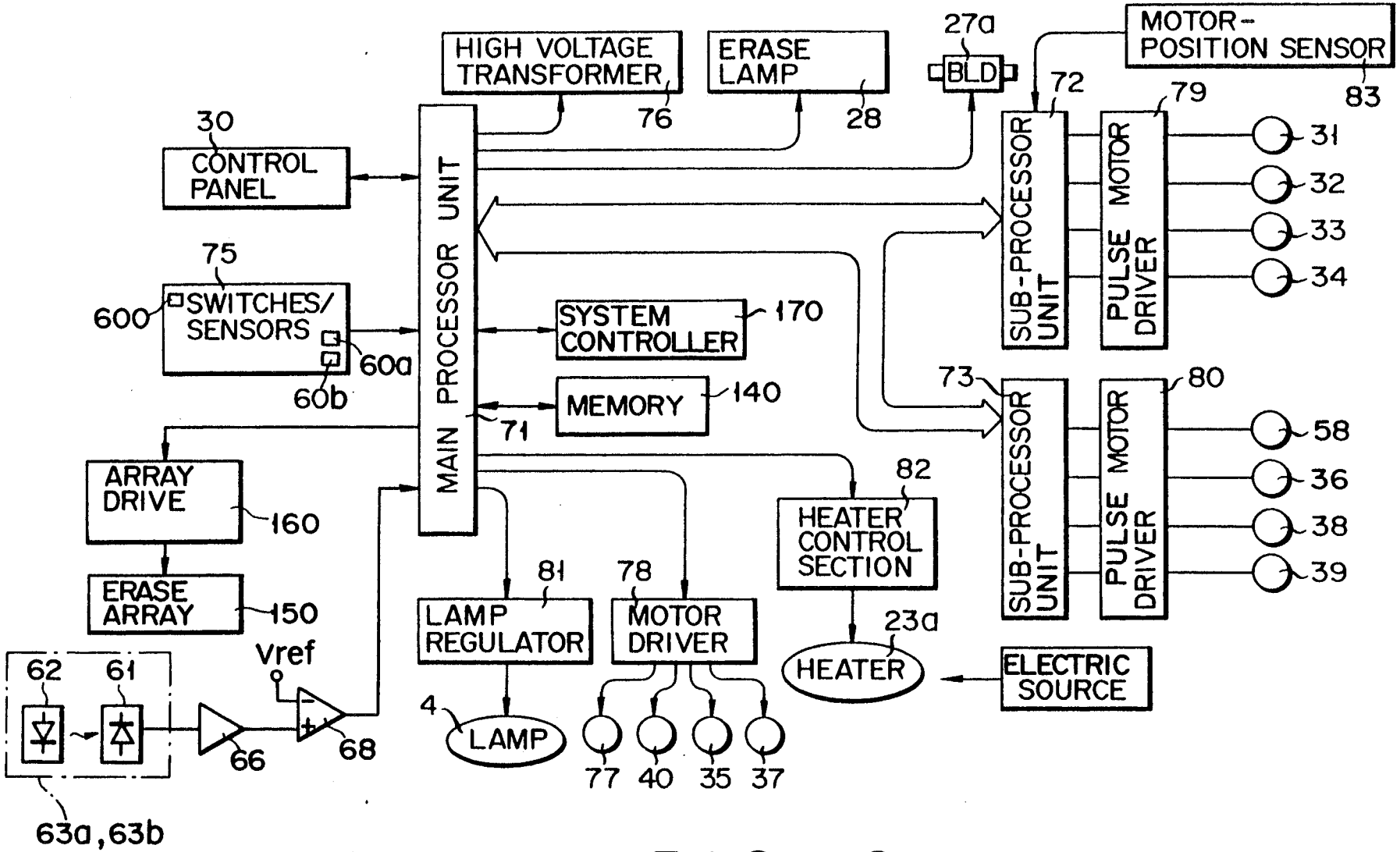
FIG. 9 shows the overall control circuit of the first embodiment.

In FIG. 9 is shown an overall control circuit of the copying machine. Main processor unit 71 detects the input from input units 75 such as the control panel 30, switches such as the cassette size detecting switches 60*a* and 60*b* and sensors. The main processor unit 71 controls a high voltage transformer 76 for operating the charger and the charge eraser, the erase lamp 28, the blade solenoid 27*a* of the cleaner 27, the heater 23*a* of the fixing rollers 23, the illumination lamp 4, the motors 31 to 40 and 58 and the others so as to carry out the copying operation. The main processor unit 71 further regulates the document detectors 63*a* and 63*b*, a memory 140, an erase array 150, an array driver 160, a system controller 170 in accordance with the inputs from the input unit 75. The main processor unit 71 is operated to erase the unnecessary stripe-like black images appearing on the outside of the copy images (output images).

The motors 35, 37 and 40 and a toner motor 77 for supplying toner to the developing section 12 are controlled by the main processor unit 71 via a motor driver 78. The motors 31 to 34 are controlled by a first sub-processor unit 72 via a pulse motor driver 79, and the motors 36, 39, 38 and 58 are controlled by a second sub-processor unit 73 via a pulse motor driver 80. The illumination lamp 4 is regulated by the main processor unit 71 via a lamp regulator 81, and the heater 23*a* is controlled by the main processor unit 71 via a heater control section 82. The start/stop commands of the respective motors are sent from the main processor unit 71 to the first and second sub-processor units 72 and 73, and status signals showing the states of the start/stop of the respective motors are delivered from the first and second sub-processor units 72 and 73 to the main processor unit 71. In the first sub-processor unit 72 is input position information from motor-position sensors 83 for detecting the initial positions of the motors 31 to 34. The first and second processor units 72 and 73 count reference clock pulses according to the set levels supplied from a microcomputer. Each of the first and second sub-processors 72 and 73 comprises the microcomputer and a programmable and invertible timer for controlling the phase change-over time interval.

The outputs (electric signals) of the photo-receptors 61 comprising the document detectors 63*a* and 63*b* are supplied by the main processor unit 71 to the system controller 170 via an amplifier 66 and a comparator 68 in which the outputs of the amplifier 66 are compared with the reference voltages Vref for compensating the variations of output levels of the photoreceptors 61 due to the variations of the sensitivity of the photoreceptors 61 and the change of temperature.

In the system controller 170 are stored position data, discrimination data, setting data and the like. The position data is used to calculate the positions of the first carriage 41*a* (the detecting positions T to Z) according to the number of pulses which are supplied to the motor 33. The discrimination data is adapted to check whether an original document exists or not in response to the outputs produced by the photoreceptors 61 and the photoemitters 62 and determines the size of an original document G in response to the outputs of the document detectors 63*a* and 63*b*. The setting data is employed to set the erase area in accordance with the detected document image size and the copy magnification designated by the magnification setting key 30*h*. The memory 140, the erase array 150 and the array driver 160 will later be described.

Figure 10:
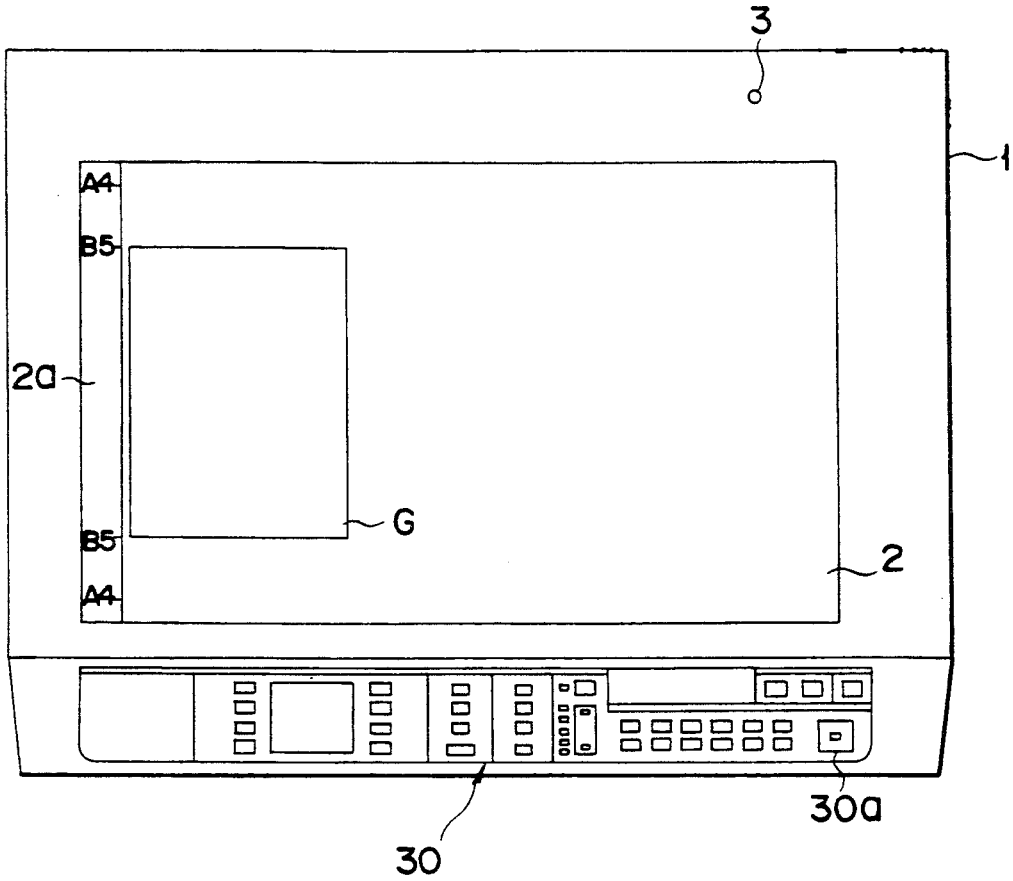
FIG. 10 illustrates how to set the region to be erased in the first embodiment.
Figure 11:
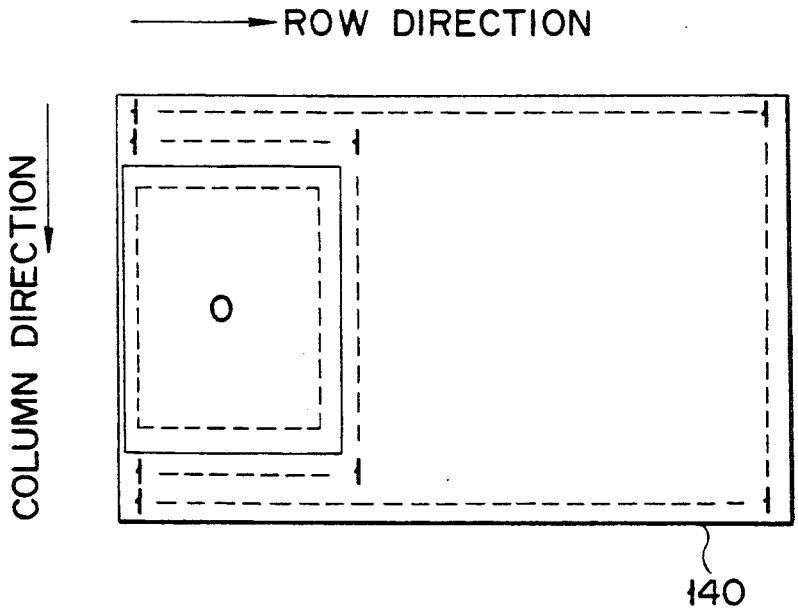
FIG. 11 is a plan view of the memory of the first embodiment.

In the next step, the erase area is set from the detected information concerning the original document size. When, for example, it is detected that the document cover 1*a* is not fully closed, as shown in FIGS. 10 and 11, the erase area is set which is outside of the document image forming region (the document image size) corresponding to the size of the original document G and the copy magnification designated by the magnification setting key 30*h* of the control panel 30. The erase area is selected from the erase area map setting data in accordance with the image size. The erase area are stored in the memory 140 by the main processor unit 71. In the memory 140, the document image region is stored as a low level signal "0", while the other region (the non-image region) is stored as a high level signal "1". The memory 140 has a capacity larger than the maximum original document size which can be copied. When the magnification is 1, the addresses in the enclosed inner region shown in FIG. 11 corresponding to the original document G in FIG. 10 are stored as low level signals, and the addresses of the outside portion of the enclosed inner region shown in FIG. 11 corresponding to the outside portion of the original document G are stored as high level signals.

Figure 12:
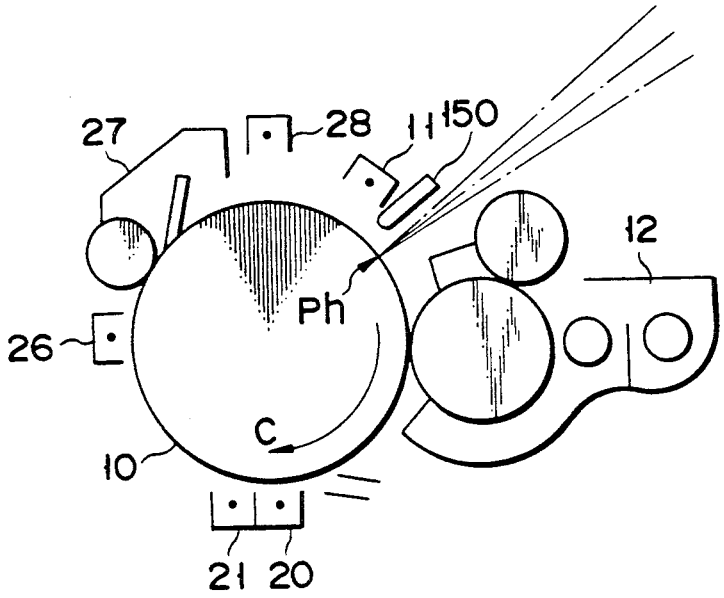
FIG. 12 shows the main portion of an embodiment of the erase array unit of the first embodiment.
Figure 13:
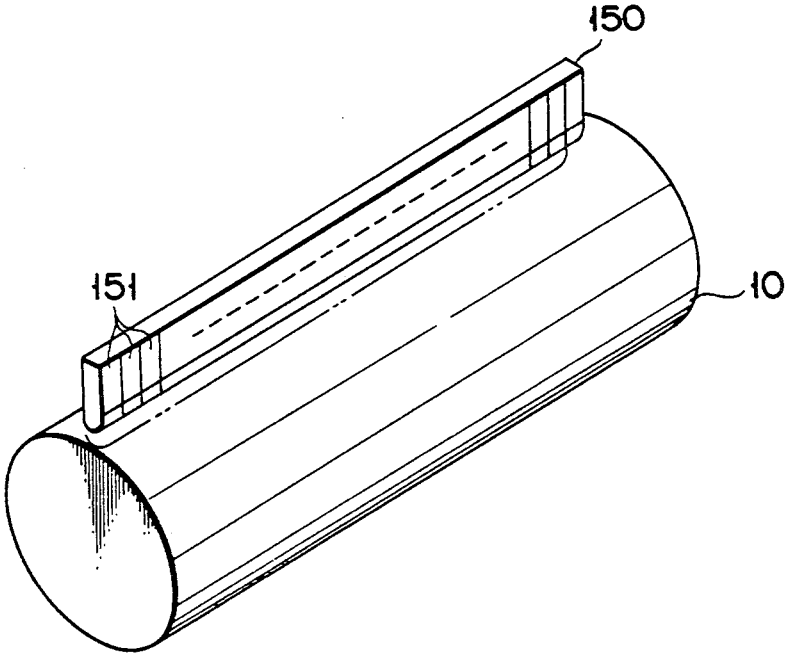
FIG. 13 is a perspective view of the erase array unit and the photoconductive drum of the first embodiment.
Figure 14:
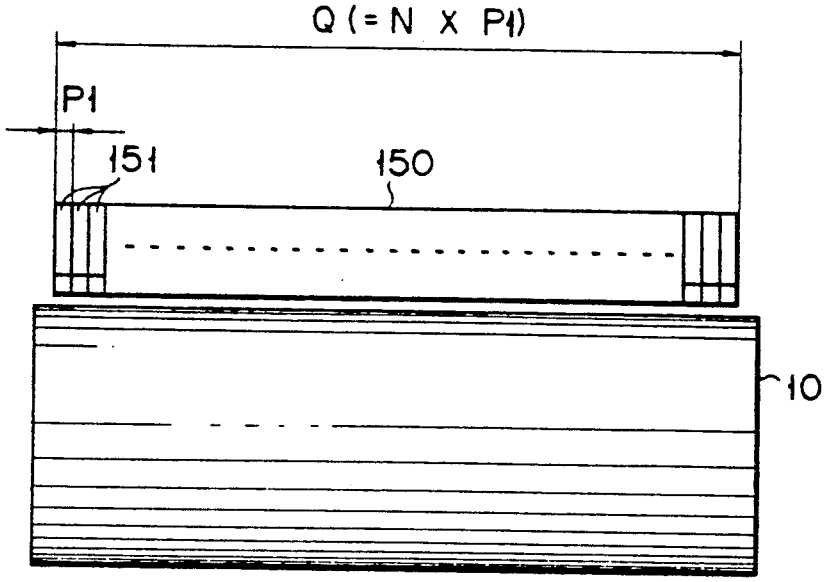
FIG. 14 is a front view of the erase array unit and the photoconductive drum.
Figure 15A:
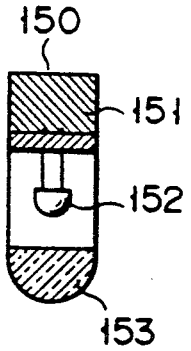
FIG. 15A is a cross-sectional view of one of the erase arrays in the array unit of the first embodiment.
Figure 15B:
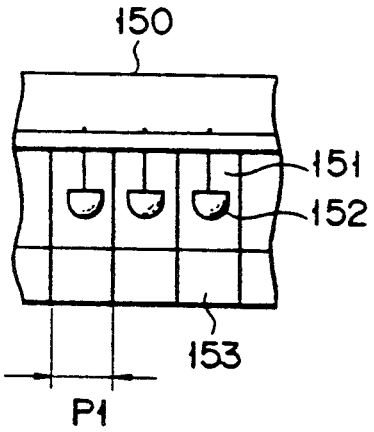
FIG. 15B is a front view of part of the array of FIG. 15A.

As shown in FIG. 12, the erase array 150 is placed close to the photoconductive drum 10 between the charger 11 and the slit exposed portion Ph. The array 150 comprises a plurality of blanking cells 151 arranged in the direction perpendicular to the rotational direction of the photoconductive drum 10, as shown in FIGS. 13 and 14. In each blanking cell 151 is housed a photoemitting element 152 comprising such as a photodiode, as shown in FIGS. 15A and 15B. A lens 153 for collecting light beams on the photoconductive drum 10 is provided at an opening formed at the end of the cell 151 facing the photoconductive drum 10. The number of the photoemitting elements 152 corresponds to the row capacity of the memory 140. Let it be assumed that the distance between the adjacent photoemitting elements 152 is P and the number of the photoemitting elements is N. Then, the total length of the erase array 150 is $Q=N\times P$.

Figure 16:
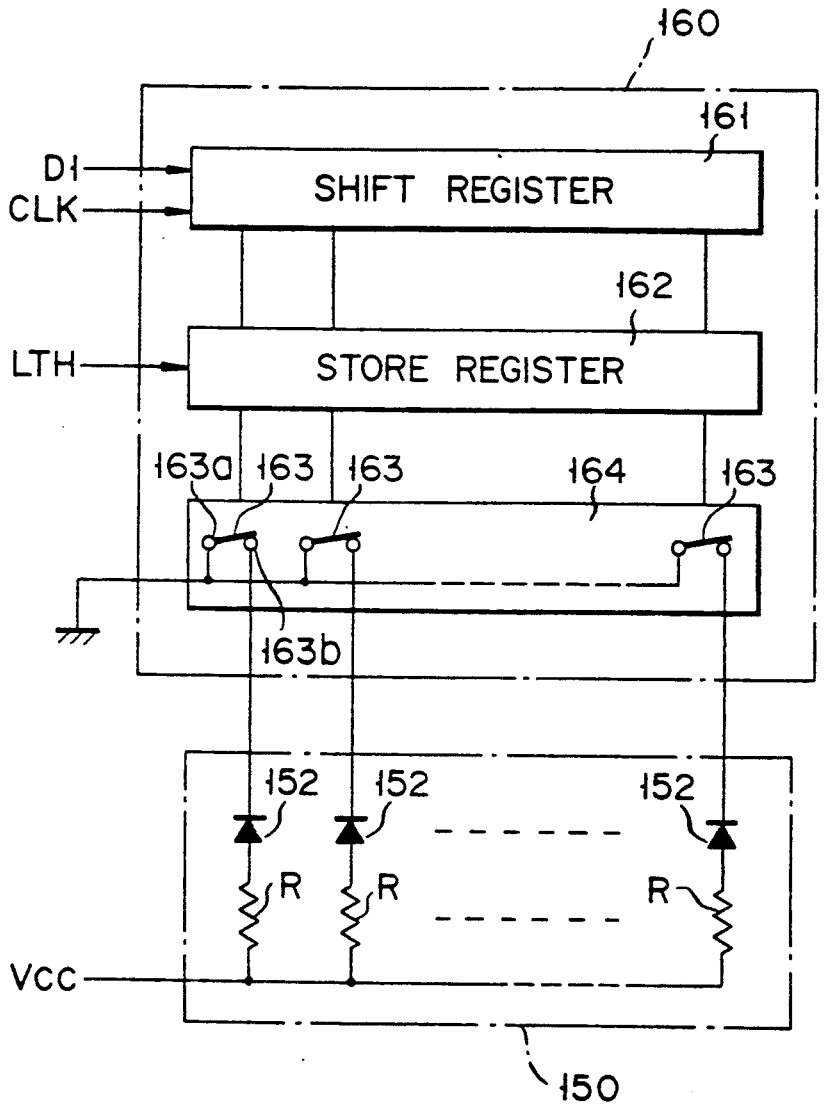
FIG. 16 is a circuit of the array driving unit of the first embodiment.

The erase array 150 is driven by the array driver 160 which, as shown in FIG. 16, comprises a shift register 160 having the same bits as the row bits of the memory 140, a store register 162 for storing the contents of the shift register 161 and a switch circuit 164 including a plurality of switch elements 163 turned on or off according to the output signals of the store register 162. The turnable element 163*a* of each switch 163 is normally grounded, and the fixed contact 130*b* thereof is connected to the cathode of the corresponding one of the photoemitting elements 152 which constitute the erase array 150. The cathode of each photoemitting element 153 is connected to an electric source Vcc through a current controlling resistor R.

After the erase area has been set, the first carriage 41*a*, the photosensitive drum 10 and the elements associated with them are operated so that rows of data as shown in FIG. 11 are read out in turn from the memory 140. The read-out data D is sent to the shift register 161 of the array driver 160 in response to clock signals CLK. When that portion of the photoconductive drum 10 which is electrically charged faces the erase array 150 after the data in the rows has been sent to the shift register 161, latch signals LTH are output from the main processor unit 71, and memory data in the shift register 161 is supplied to the store register 162 in response to the latch signals LTH. In other words, the output timing of the latch signals LTH is controlled so that the row data outputs from the memory 140 are supplied to the store register 162 before $\theta/\omega$ where it is assumed that the angle between the erase array 150 and the exposed portion Ph is $\theta$ and the angular velocity of the rotating photosensitive drum 10 is $\omega$.

The switch elements 163 are controlled by the output signals of the store register 162. When an output level of the store register 162 is high, the corresponding switch 163 is turned on, while the output level is low, the switch 163 is turned off. In consequence, the corresponding photoemitting element 152 is turned on or turned off when the switch element 163 is turned on or off, respectively. The electric charges are removed which are loaded on the portion of the photoelectric drum 10 where the photoemitting elements 152 are illuminated. That portion of the photosensitive drum 10 from which the electric charges have been removed is not formed with electrostatic latent images even if it is illuminated with light beams afterwards. It means that the images are removed from this portion. The same steps are repeated and the unnecessary black images appearing on the peripheral portions of the copy sheet are erased every time row data are read out.

Figure 17:
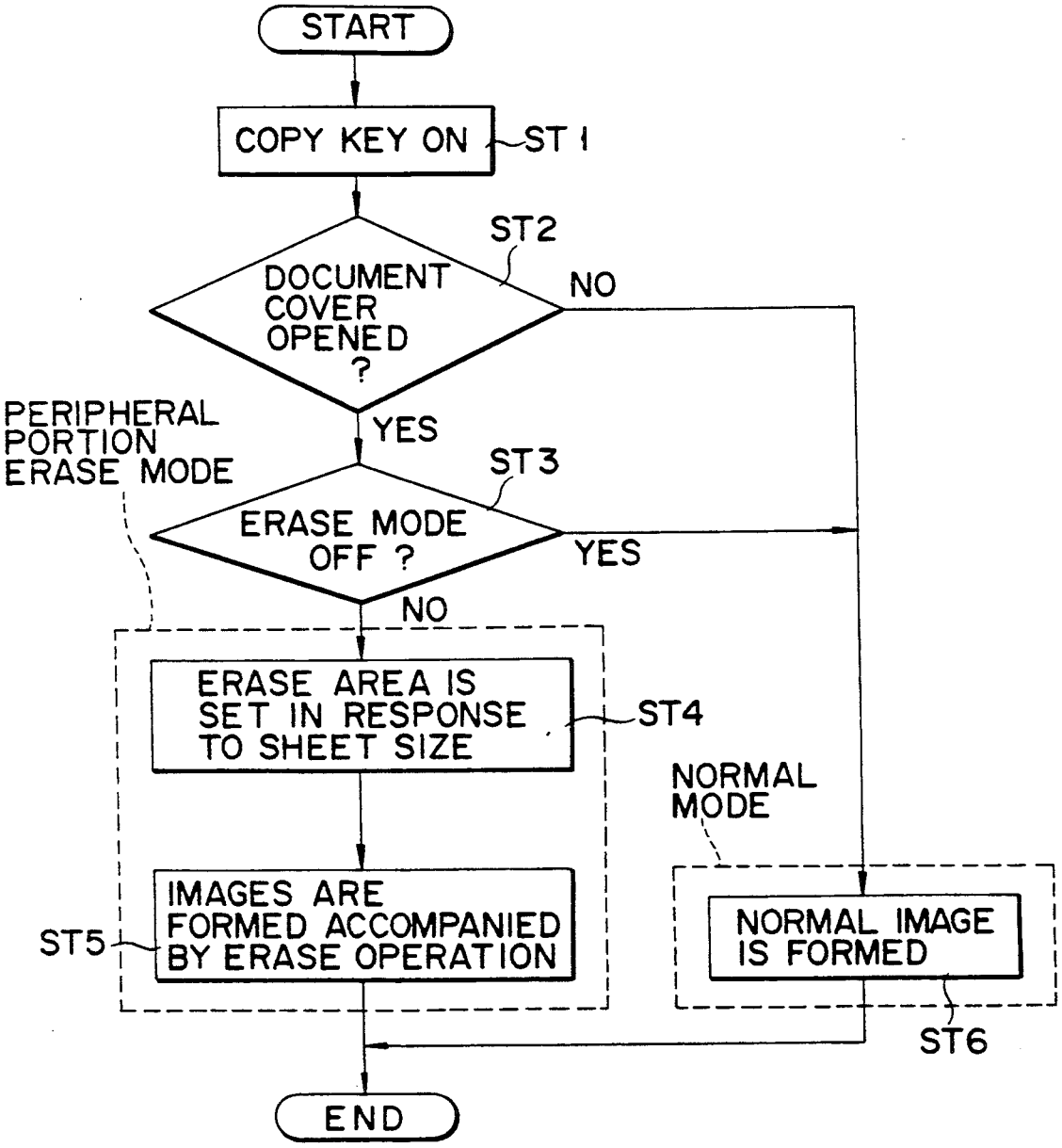
FIG. 17 is a flow chart illustrating the operation of the first embodiment.

The erasing operation will now be explained with reference to the flow charts shown in FIGS. 17 and 18. In FIG. 17, an original document G is placed on the document table 2 and the copy key 30*a* on the control panel 30 is turned on (ST1). Then, it is checked whether the document cover la is fully closed or not by the information from the cover detecting switch 3 (ST2). When it is determined that the document cover 1*a* is not fully closed, the erase mode is set to an on state in step ST3 while the check mode is set to be on. In step ST5, the previously set erase area is read out from the memory 140 and high level signals are memorized in the addresses.

Figure 19A:
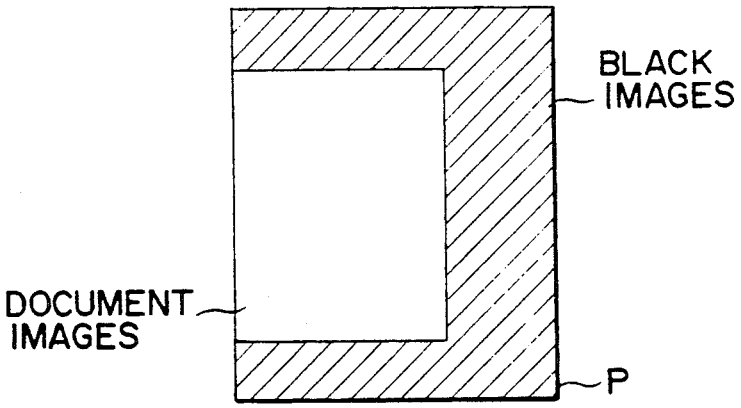
FIG. 19A shows the positional relationship between an original document in the form of a sheet and a copy sheet which is larger than the original document so that black images appear thereon.
Figure 19B:
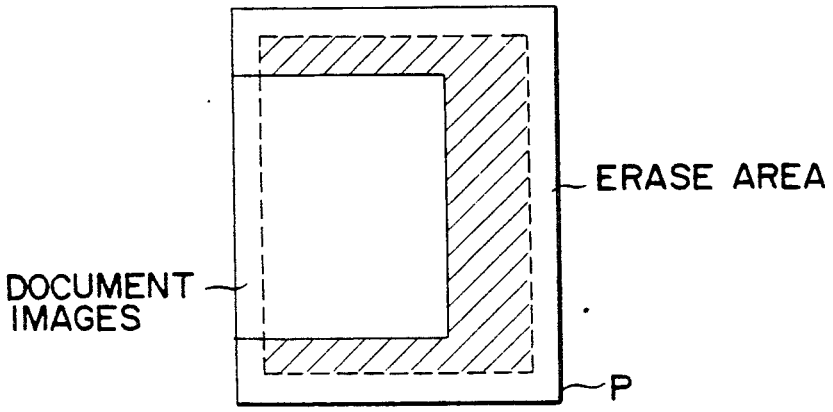
FIG. 19B illustrates a positional relationship between the document images and the copy images on the copy sheet from which the unnecessary black peripheral images are removed.

Thereafter the image formation process is carried out in step ST5 as described below. The illumination lamp 4 is turned on by the lamp regulator 81 under the control of the main processor unit 72. Then, the document reading operation for forming images is carried out by moving the motor 33 by means of the pulse motor driver 79 under the control of the first sub-processor unit 72 in the direction in which the first carriage 41*a* is moved from the reading start position in the direction in which the first carriage 41*a* is separated from the second carriage 41*b*. The motor 36 and the associated elements therewith are driven by the pulse motor driver 80 under the control of the second sub-processor unit 73 so that the photosensitive drum 100 is rotated, and the erase array 150 is driven by means of the array driver 160. The photoemitting elements 152 are turned on according to the data from the memory 140. The electric charges are removed from that portion of the surface of the photosensitive drum 10 which corresponds to the erase area determined by the illuminated photoemitting elements 152. No electrostatic latent images are formed on this portion from which electric charges are removed by the erase array 150 even if it is illuminated with light beams. When, therefore, the document cover 1*a* is not fully closed, the copy images on a copy sheet P does not include unnecessary black peripheral portion (as shown by oblique lines in FIG. 19A) as shown in FIG. 19B, and good-looking hard copies are always obtained.

When the document cover 1*a* is not fully closed upon putting a thick original document such as a book on the document table 2, no unnecessary-peripheral black images appear around the copy images so as to obtain goodlooking copies.

When, on the contrary, it is checked that the document cover 1*a* is not opened in step ST2 and the erase mode is in an off state, the erase step is skipped and the regular copying carried out in step ST6. In other words, when the document cover 1*a* is fully closed, no unnecessary black images appear around the copy images. In this case, the erase mode need not be set.

After the copy images have been formed on the required number of copy sheets, the copying machine is set to a waiting state.

Figure 18:
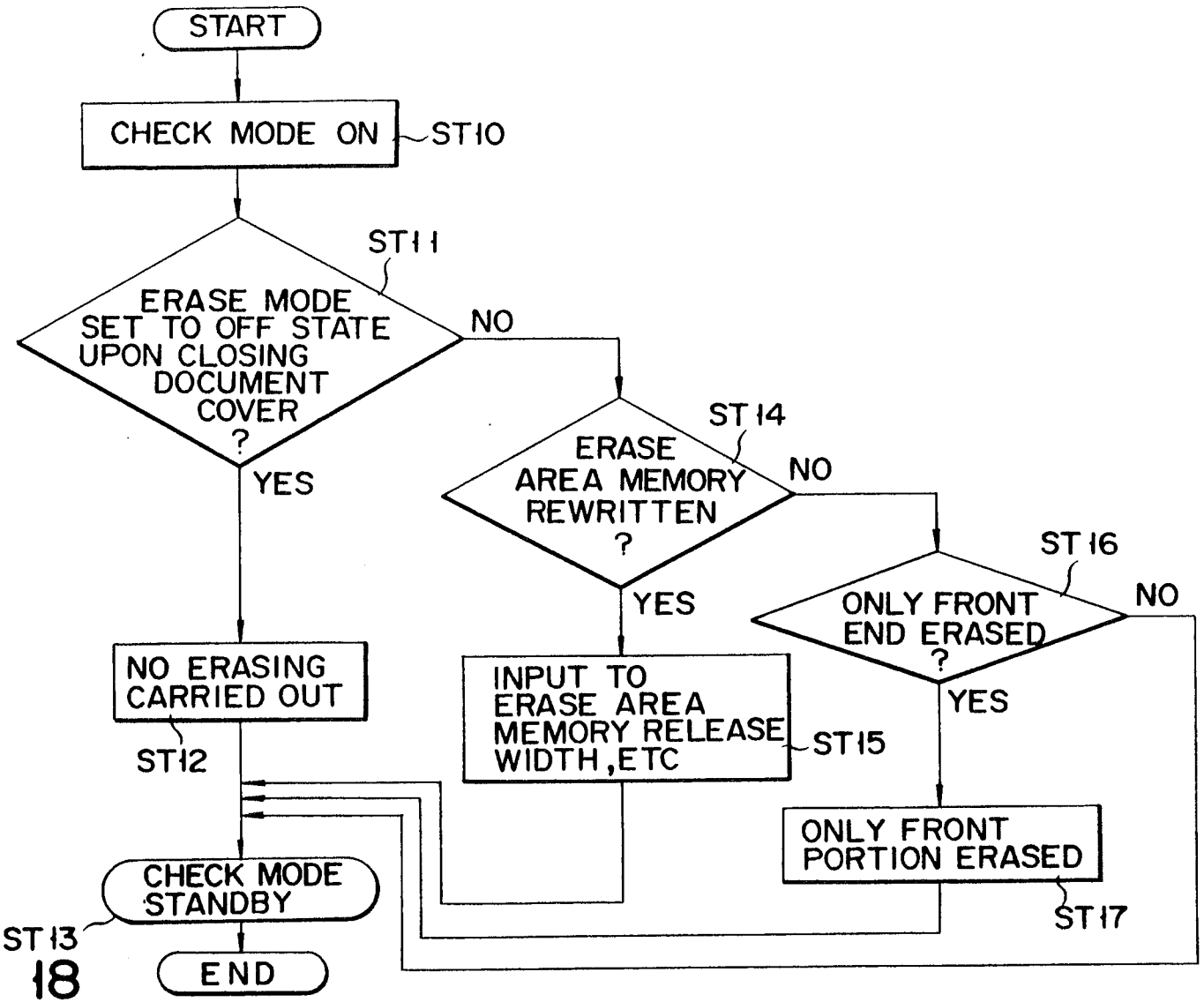
FIG. 18 is a flow chart showing how to set the erase mode in the first embodiment.

The erase area is set according to the flow chart in FIG. 18. The depression of the erase mode key 30*x* sets the check mode to an on state in step ST10. Then, it is decided in step ST11 whether the erase mode is set to an off state or not, when the document cover 1*a* is opened. In this state, when the erase mode is set to an off state, erasing is not carried out in step ST12 and the check mode is set to a standby state in step ST13. Upon turning off the standby state, the check mode is ended.

When the erase mode is set to an on state in case the document cover is opened in step ST11, it is decided whether the erase area is set or not in step ST14. Where it is decided that the erase area is to be set, the size of the peripheral area to be erased is set according to the size of the copy sheet in step ST15 and the area to be erased is memorized in the memory 140. Thereafter, the check mode is turned to a standby state in step ST13.

In case when it is decided that the erase area is not set in step ST14, it is determined whether only the front portion is erased in step ST16. When it is decided that only the front portion should be erased, the setting is made for erasing that erase area of the front portion which is memorized in the memory 140 in step ST17. Then, the check mode is set to a standby state in step ST13.

As explained above, when the document cover is opened and the erase mode is set to an on state, unnecessary electric charges are removed from that portion of the surface of the photosensitive drum which corresponds to the outside-of-document image area, whereby the unnecessary black images otherwise appearing on the peripheral portion of the copy sheet are erased. In other words, when the document cover is not fully closed or it cannot be closed because the original document is very thick, the unnecessary peripheral black images which causes the waste of toner are prevented from being formed.

In this connection, attractive copy sheets of a high quality can be obtained. Further, the developing agent such as toner is not attached to the portion of the copy sheet around the copy images corresponding to the document images and not wasted. This hinders the copy sheet from being wound around the fixing roller.

Since these attractive copy images without the unnecessary black peripheral images can be obtained even if the document cover is kept opened, this image forming apparatus has a technical advantage that it is unnecessary for the operator to close the document cover every time the copy is carried out.

This invention is not limited to the abovementioned embodiment. In another embodiment, the erase operation is carried out when the document cover is fully closed. However, the erasing operation can be carried out so that, when dirt attaches to the undersurface of the document cover, images of the dirt are not formed as unnecessary black images on the copy sheet.

In the above-described embodiment, it is detected that the document cover 1*a* is opened by the input from the cover detecting switch 3. However, the brightness or the level of reflected light beams is detected so that it is determined that the document cover 1*a* is opened when the contrast of the original document G is lower than a constant value.

Figure 20:
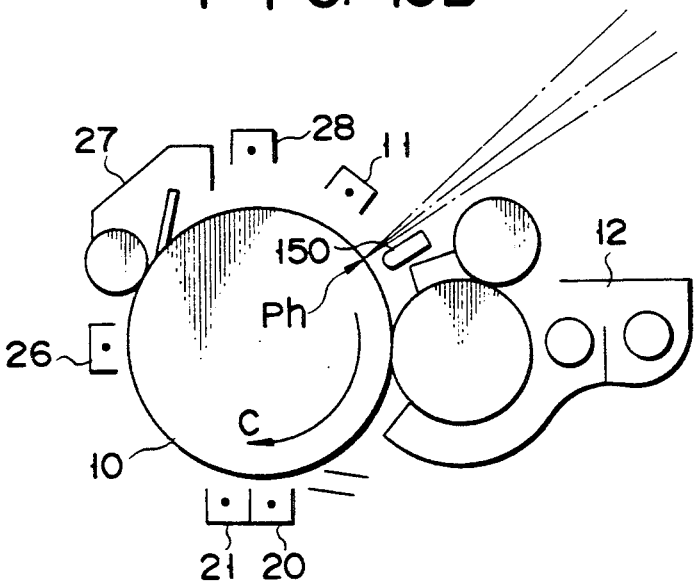
FIG. 20 is a cross-sectional view of the main portion of a modification of the erase array unit.

The array 150 is not always provided at the position shown in FIG. 12 (FIG. 20), but it can be placed between the exposed portion Ph and the developing section 12 so as to erase formed electrostatic latent images according to the erase area.

Figure 21:
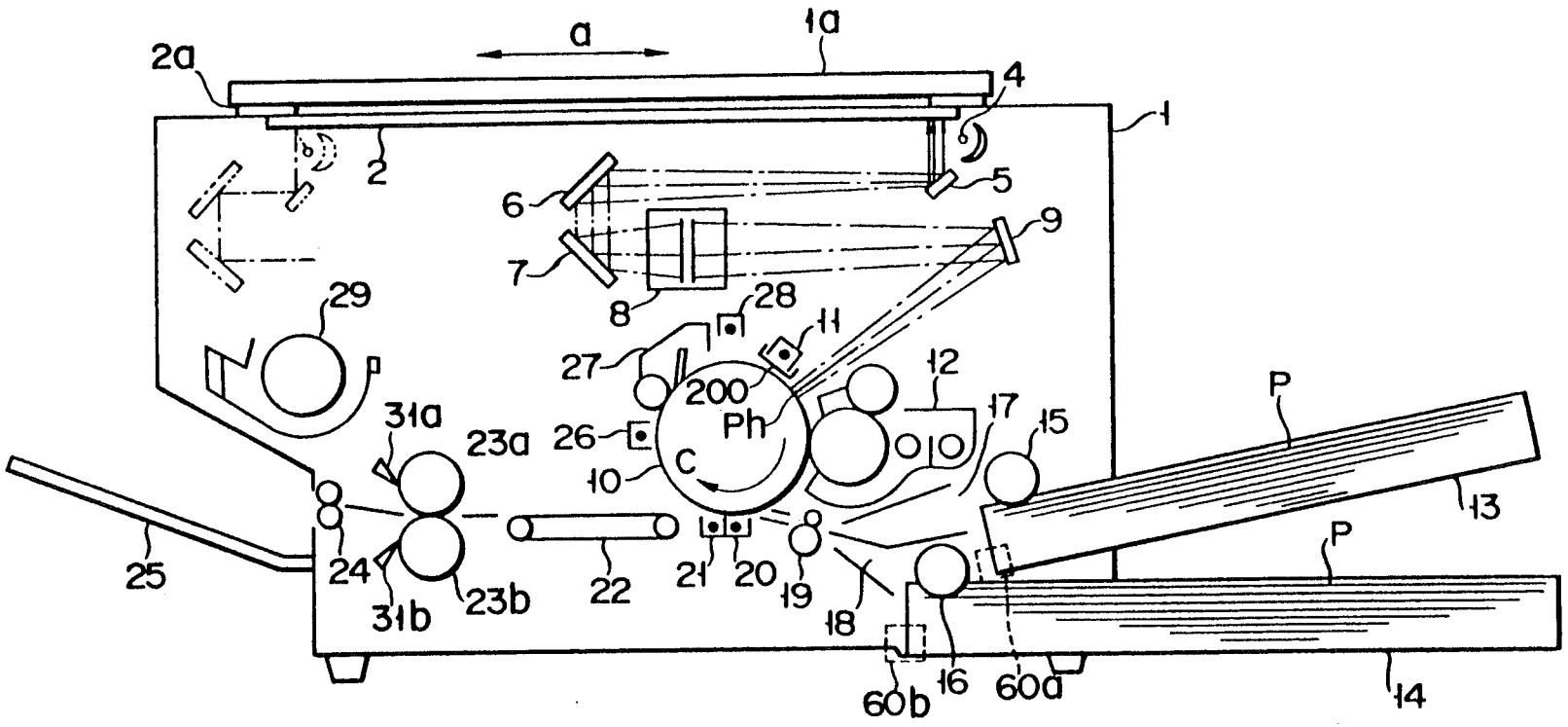
FIG. 21 is a cross-sectional view of a second embodiment of the copying machine according to this invention.

A second embodiment will now be described with reference to the drawings which has the same structure as the first embodiment except for the peripheral elements of the photosensitive drum. The same elements and the parts of the second embodiment the same as those of the first embodiment are denoted by the same reference numerals, the description thereof being omitted. FIG. 21 shows the second embodiment of the image forming apparatus. The first embodiment is provided with an erase array 150 for erasing unnecessary electric charges. In the second embodiment, however, a charging shutter 200 is provided instead.

The second embodiment has a control panel 30, driving sources of the driving potions of the copying machine and a driving mechanism for reciprocating an optical system having the same structure as those of the first embodiment.

Figure 23:
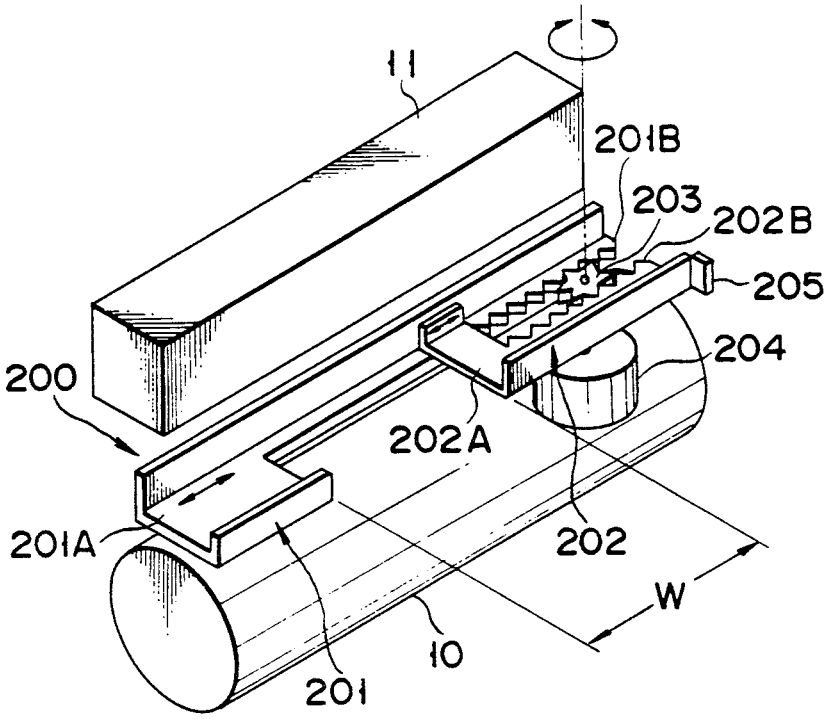
FIG. 23 shows the overall control circuit of the second embodiment.
Figure 24:
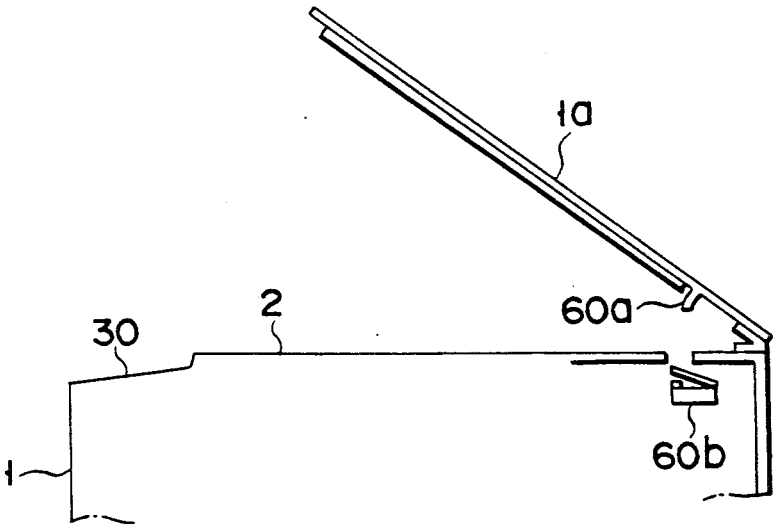
FIG. 24 is a cross-sectional view of a modification of a cover detecting switch.

As shown in FIG. 23, the charging shutter 200 is provided between a photosensitive drum 10 and a charger 11 so as to be disposed close to them, and has two shutters 201 and 202 extending in the direction perpendicular to the rotational direction of the photosensitive drum 10. The shutters 201 and 202 respectively have charge shielding portions 201A and 202A movably provided close to the respective ends of the photoconductive drum 10, racks 201B and 202B facing each other and engaging with a gear 203 which is rotated by means of a charger motor 204. Forces are applied to the racks 201A and 202B so as to vary the positions of the charge shielding portions 201A and 202A of the shutters 201 and 202 with the result that the width W of the opening defined by the charge shielding portions 201A and 202A is varied. Thus, the surface portion of the photosensitive drum 10 which corresponds to the opening can be electrically charged and the surface portions of the drum 10 which are covered with the charge shielding portions 201*a* and 202A are not electrically charged.

Figure 22:
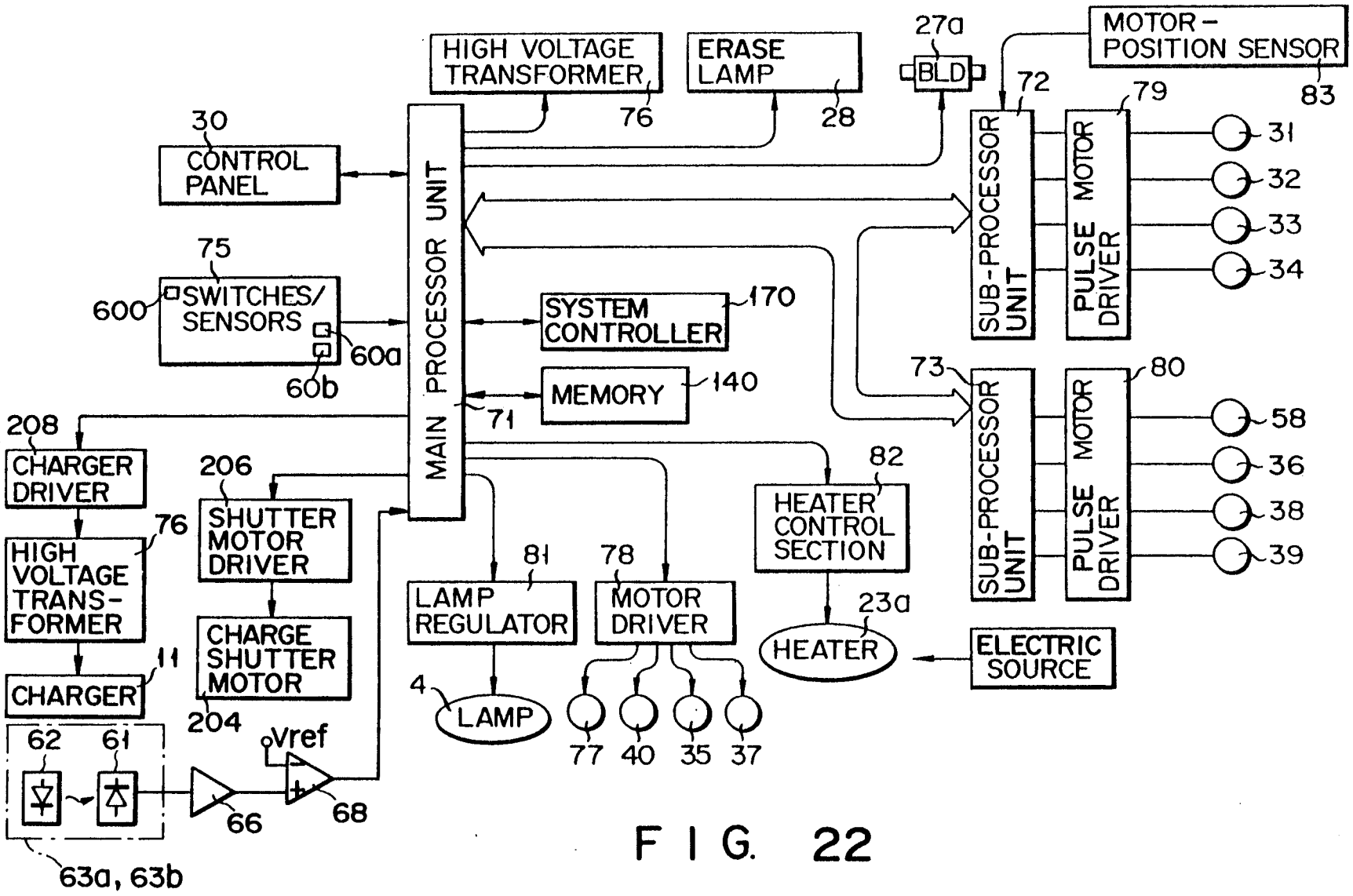
FIG. 22 is a block diagram showing the operation of the second embodiment.

FIG. 22 shows an overall control circuit of the second embodiment. A main processor unit 71 detects the inputs from a control panel 30, switches, a sensor and input units 75 such as cassette size detecting switches 60*a* and 60*b*. The main processor unit 71 further controls a high voltage transformer 76, an erase lamp 28, a blade solenoid 27*a* of a cleaner 27, heaters of a pair of fixing rollers 23*a* and 23*b*, an illumination lamp 4 and motors 31 to 40 and 58 so as to perform the copying operation. The main processor unit 71 still further controls document detectors 63*a* and 63*b*, a memory 140, a charger motor 204, a shutter driver 206, a system controller 170 and the like in accordance with the inputs from the input units 75. By using this system, unnecessary black images appearing on the peripheral portion of the copy sheet are erased.

The motors 35, 37 and 40 and a toner motor 77 for supplying toner to a developing section 12 are driven by a motor driver 78 under the control of the main processor unit 71. The motors 31 to 34 are driven by a pulse motor driver 79 under the control of a first sub-processor unit 72, and the motors 36, 39, 38 and 58 are driven by a pulse motor drier 80 under the control of a second sub-processor unit 73. Under the control of the main processor unit 71, the illumination lamp 4 is operated by a lamp regulator 81 and the heater is operated by a heater controlling section 82. The drive/stop commands of the motors are sent from the main processor unit 71 to the first and second processor units 72 and 73, and the status signals indicating the drive/stop states of the motors are sent from the first and second sub-processor units 72 and 73 to the main processor unit 71. The position information from the sensor 83 for detecting the initial positions of the motors 31 to 34 is input in the first sub-processor unit 72. Each of the first and second sub-processor units 72 and 73 comprises a microcomputer or the like and a programmable and invertible timer or the like which counts reference clock pulses in response to the set levels supplied from the microcomputer and controls the phase change time interval of the pulse motor.

The outputs (electric signals) of the photo-receptors 61 comprising the document detectors 63*a* and 63*b* are supplied from the main processor unit 71 to the system controller 170 via an amplifier 66 and a comparator 68 in which the outputs of the amplifier 66 are compared with the reference voltages Vref for correcting the variations of output levels of the photo-receptors 61 due to the variations of the sensitivity of the photoreceptors 61 and the change of temperature.

In the system controller 170 are stored position data, discrimination data, setting data and the like. The position data is used to calculate the positions of the first carriage 41*a* (the detecting positions T to Z) according to the number of pulses which are supplied to the motor 33. The discrimination data is adapted to check whether an original document exists or not in response to the outputs produced by the photoreceptors 61 and the photoemitters 62 and to determine the size of an original document G in response to the outputs of the document detectors 63*a* and 63*b*. The setting data is employed to set the erase area in accordance with the detected document image size and the copy magnification designated by the magnification setting key 30*h*. The memory 140, the erase array 150 and the array driver 160 will later be described.

In the next step, the erase area is set from the detected information concerning the original document size. When, for example, it is detected that the document cover 1*a* is not fully closed, as shown in FIGS. 10 and 11, the erase area is set which is outside of the original document image forming region (the original document image size) corresponding to the size of the original document G and the copy magnification designated by the magnification setting key 30*h* of the control panel 30. The erase area is selected from the erase area map setting data in accordance with the image size. The erase areas are stored in the memory 140 by the main processor unit 71. In the memory 140, the original document image region is stored as a low level signal "0", while the other region (the non-image region) is stored as a high level signal "1". The memory 140 has a capacity larger than the maximum original document size which can be copied. When the magnification is 1, the addresses in the enclosed inner region shown in FIG. 11 corresponding to the original document G in FIG. 10 are stored as low level signals, and the addresses outside of the enclosed inner region shown in FIG. 11 corresponding to the outside portion of the original document G are stored as high level signals.

As shown in FIG. 22, the charger shutter motor 204 is rotated by means of the shutter motor driver 206 which changes the positions of the charge shielding portions 201A and 2020A according to the data from the memory 140 corresponding to the size of the copy sheet when the size is detected s that the portions of the photosensitive drum 10 which are covered with the charge shielding portions 201A and 202A are not electrically charged. No electrostatic latent images are formed on the non-charged portions when they are illuminated with light beams afterwards and the portions have the same effect as if images were erased therefrom. In such a way, the shutters 201 and 202 are controlled corresponding to the outside-of-document portions so that the unnecessary black images are not formed on the peripheral portion of the copy sheet.

The charger 11 is connected to the high voltage transformer 76 and is driven by a charger driver 208 which is connected to the main processor unit 71 and the charge timing of which is controlled thereby. Upon detecting the size of the copy sheet, the on/off timing of the charger 11 is controlled in accordance with the data output from the memory and corresponding to the size of the copy sheet. During the copying operation, the portion of the photosensitive drum 10 which contacts the front portion of the copy sheet is not electrically charged by the charger 11, but the charging operation starts on a predetermined portion of the photosensitive drum 10 and ends on the portion of the photosensitive drum 10 which corresponds to the front portion at which the rear portion of the copy sheet begins. In this connection, by controlling charging timing of the photosensitive drum 10, the front and rear end portions of the copy sheet extending along the axis of the photosensitive drum 10 are not electrically charged so that no unnecessary black stripe images are formed on both end portions of the copy sheet. This is attained by the on and off operations of the charger shutter and the charger.

The second embodiment is operated in accordance with flow charts as shown in FIGS. 17 and 18 as used for the first embodiment. For example, an original document G is placed on the document table 2 and the copy key 30*a* on the control panel 30 is turned on (ST1). Then, it is checked whether the document cover 1*a* is fully closed or not by the information from the cover detecting switch 3 (ST2). When it is determined that the document cover 1*a* is not fully closed, the erase mode is set to an on state in step ST3 while the check mode is set to be an on state. In step ST5, the previously set erase area is read out from the memory 140 and high level signals are memorized in the addresses.

Thereafter, the image formation process is carried out in step ST5, as described below. The illumination lamp 4 is turned on under the control of the main processor unit 72 via the lamp regulator 81. Then, the document reading operation for forming images is carried out by moving the motor 33 by means of the pulse motor driver 79 under the control of the first sub-processor unit 72 in the direction in which the first carriage 41*a* is moved from the reading start position in the direction in which the first carriage 41*a* is separated from the second carriage 41*b*. The motor 36 and the associated elements therewith are driven by the pulse motor driver 80 under the control of the second sub-processor unit 73 so that the photosensitive drum 100 is rotated, and the charger shutter 200 is driven by means of the charger shutter motor 204. As a result, the movement of the charge shielding portions 201A and 202A is controlled according to the data from the memory 140. In other words, the timing of applying a high voltage to the charger 11 is controlled so that the portions of the photosensitive drum 10 which correspond to the front and rear portions of the copy sheet and both side portions of the photosensitive drums 10 which are covered with the charge shielding portions 201A and 202B are not electrically charged. This means that no latent images and thus visible images visualized by toner are not formed. When, therefore, the document cover 1*a* is not fully closed, the copy images on a copy sheet P does not include unnecessary black peripheral portion (as shown by oblique lines in FIG. 19A) as shown in FIG. 19B, and good-looking hard copies are always obtained.

When the document cover 1*a* is not fully closed upon putting a thick original document such as a book on the document table 2, no unnecessary peripheral black images appear around the copy images whereby attractive copies are obtained.

When, on the contrary, it is checked that the document cover 1*a* is not opened in step ST2 and the erase mode is in an off state, the erase step is skipped and the regular copying carried out in step ST6. In other words, when the document cover 1*a* is fully closed, no unnecessary black images appear around the copy images. In this case, the erase mode need not be set.

After the copy images have been formed on the required number of copy sheets, the copying machine is set to a waiting state.

The erase area is set according to the flow chart in FIG. 18 as in the case of the first embodiment. The depression of the erase mode key 30*x* sets the check mode to an on state in step ST10. Then, it is decided in step ST11 whether the erase mode is set to an off state or not, when the document cover 1*a* is opened. When the erase mode is set to an off state, erasing is not carried out in step ST12 and the check mode is set to a standby state in step ST13. When the standby state is turned off, the check mode is ended.

When the erase mode is set to an on state, in case the document cover is opened in step ST11, it is decided whether the erase area is set or not in step ST14. Where it is decided that the erase area is to be set, the size of the peripheral area to be erased is set according to the size of the copy sheet in step ST15. The area to be erased is memorized in the memory 140. Thereafter, the check mode is turned to a standby state in step ST13.

In case when it is decided that the erase are is not set in step ST14, it is determined whether only the front portion should be erased in step ST16. Upon deciding that only the front portion is erased, the setting is made for erasing that erase area of the front portion which is memorized in the memory 140 in step ST17 and then the check mode is set to a standby state in step ST13.

As explained above, when the document cover is opened and the erase mode is set to an on state, the unnecessary electric charges are removed from that portion of the surface of the photosensitive drum which corresponds to the outside-of-document image area, whereby the unnecessary black images otherwise appearing on the peripheral portion of the copy sheet are erased. In other words when the document cover is not fully closed or it cannot be closed because the original document is very thick, the unnecessary peripheral black images which causes the waste of toner are prevented from being formed.

In this connection, copied sheets of high quality can be obtained. Further, the developing agent is not attached to the portion of the copy sheet around the copy images corresponding to the original document images so as not to be wasted. This hinders the copy sheet from winding around the fixing roller.

Since attractive copy images without the unnecessary black peripheral images can be obtained even if the document cover is kept opened, this image forming apparatus has a technical advantage that it is unnecessary for the operator to close the document cover every time the copy is carried out.

This invention is not limited to the above-mentioned embodiment. For example, the erasing operation can be carried out so that, when dirt attaches to the undersurface of the document cover, images of the dirt are not formed as unnecessary black images on the copy sheet.

In the above-described embodiment, it is detected that the document cover 1*a* is opened by the input from the cover detecting switch 3. However, the brightness or the level of reflected light beams is detected so that it is determined that the document cover 1*a* is opened when the contrast of the original document G is lower than a constant value.

In the above two embodiments, the cover detecting switch 3 is provided at the position shown in FIG. 2, but it may be placed at the front portion of the document cover 1*a*. Further, the cover detecting switch unit is not limited to the switch as shown in FIG. 2 but it may be a compound switch comprising switches 60*a* and 60*b* as shown in FIG. 23 or a combination of a magnet and a lead switch.

Needless to say, various modifications are available within the scope of this invention.

As explained above, this invention provides an image forming apparatus which erases or does not produce black images otherwise appearing on the peripheral portion on a copy sheet, even if the original document cover is opened, thereby improving the quality of images on the copy sheet, and freely selects the peripheral range on the copy sheet on which peripheral black images should not be formed.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus, comprising:
- cover means for supporting an original document having an image thereon;
- means for forming the image on a material;
- means for charging an image bearing member to a predetermined voltage;
- means for emitting a light that impinges on the original document and for guiding the light reflected from the original onto the image bearing member;
- means for transferring the image from the image bearing member to the material;
- means for detecting the dimensions of the material; and
- means for erasing the electric charge on the image bearing member corresponding to the non-image region outside of the image region when the material size is larger than the image region, but not erasing the electric charge when dimensions of the material are equal to or smaller than the image region.

2. An image forming apparatus according to claim 1, wherein the erasing means comprises an erase array of a plurality of photodiodes for emitting light onto the non-image region of the image bearing member.

3. An image forming apparatus according to claim 1, wherein the erasing means comprises an adjustable charger shutter for preventing the non-image region of the image bearing member from being charged by a corona discharge.

4. An image forming apparatus according to claim 1, further comprising means for selecting either an automatic erasing mode or a non-erasing mode, regardless of the open or closed position of the cover means.

5. An image forming apparatus comprising:
- cover means for supporting an original document having an image thereon;
- openable and closable means for covering the supporting means;
- means for detecting an open condition when the covering means is open;
- means for forming the image on a material, the forming means having
  - a means for charging an image bearing member to a predetermined voltage;
  - means for emitting a light to impinge on the original document and for guiding the light from the original document onto the image bearing member;
  - means for transferring the image from the image bearing member to the material;
- means for detecting the dimensions of the material;
- means for erasing any electric charge on the image bearing member corresponding to a non-image region outside of the image region when the material dimensions are larger than the intended image region, and not erasing the electric charge when the material dimensions are equal to or less than the image region or when the covering means is closed.

6. An image forming apparatus according to claim 5, wherein the erasing means comprises an erase array having a plurality of photodiodes for emitting light onto the non-image region of the image bearing member.

7. An image forming apparatus according to claim 5, wherein the erasing means comprises an adjustable charger shutter for preventing the non-image region of the image bearing member from charging by a corona discharge from the charging means.

8. An image forming apparatus according to claim 5, further comprising means for selecting either an automatic erasing mode or non-erasing mode, regardless of the position of the cover means.

9. An image forming apparatus comprising:
- cover means for supporting an original document having an image thereon;
- openable and closable means for covering the supporting means;
- means for detecting an open condition when the covering means is open;
- means for forming the image on a material, including;
  - means for charging an image bearing member to a predetermined voltage;
  - means for emitting light to impinge on the original document and guide the light reflected from the original onto the image bearing member;
  - means for transferring the image from the image bearing member to the material;
  - means for detecting the size of the material;
  - means for erasing any electric charge on the image bearing member corresponding to a non-image region outside of the image region when the material size is greater than the image region and when, during image forming, the cover means is open, and not erasing the electric charge when the material size is equal to or less than the image region or when the cover means is closed.

10. An image forming apparatus according to claim 9, wherein the erasing means comprises an erase array having a plurality of photodiodes for emitting light onto the non-image region of the image bearing member.

11. An image forming apparatus according to claim 9, wherein the erasing means comprises an adjustable charger shutter for preventing the non-image region of the image bearing member from being charged by a corona from the charging means.

12. An image forming apparatus according to claim 9, further comprises means for selecting either an automatic erasing mode or a non-erasing mode, regardless of the position of the cover means.

13. An image forming apparatus comprising:
- cover means for supporting an original document having an image thereon;
- means for detecting the size of the original document;
- openable and closable means for selectively covering the supporting means;
- means for detecting if the cover means is open;
- means for forming the image on a material; having
  - means for charging an image bearing member to a predetermined voltage;
  - means for emitting a light to impinge on the original document and for guiding the light reflected from the original onto the image bearing member;

means for transferring the image from the image bearing member to the material;

means for setting an image forming magnification at which the image is formed by the optical means;

means for identifying a region of the image formed on the image bearing member according to the magnification controlled by the setting means and the original document size detecting means;

means for detecting the size of the material;

means for erasing any electric charge on the image bearing member corresponding to a non-image region outside the image region when the material size is greater than the image region; and means for operating the erasing means when the cover means is open.

14. An image forming apparatus according to claim 13, wherein the erasing means comprises an erase array having a plurality of photodiodes for emitting a light onto the non-image region of the image bearing member.

15. An image forming apparatus according to claim 13, wherein the erasing means comprises an adjustable charger shutter for preventing the non-image region of the image bearing member from being charged by a corona from the charging means.

16. An image forming apparatus according to claim 13, wherein the setting means comprises a control panel having keys for inputting the magnification, an indication section density input key, and an ID counting key.

17. An image forming apparatus according to claim 13, further comprising means for selecting either an automatic erasing mode or a non-erasing mode, whether the cover is open or closed.

* * * * *